US010941628B2

(12) United States Patent
McAdam et al.

(10) Patent No.: US 10,941,628 B2
(45) Date of Patent: Mar. 9, 2021

(54) ADJUSTABLE BLOWOUT PREVENTER AND METHODS OF USE

(71) Applicant: Dreco Energy Services ULC, Edmonton (CA)

(72) Inventors: David McAdam, Calgary (CA); Brian McAdam, Calgary (CA); James Orr, Sherwood Park (CA)

(73) Assignee: DRECO ENERGY SERVICES ULC, Calgary (CA)

( * ) Notice: Subject to any disclaimer, the term of this patent is extended or adjusted under 35 U.S.C. 154(b) by 87 days.

(21) Appl. No.: 16/139,690

(22) Filed: Sep. 24, 2018

(65) Prior Publication Data

US 2019/0093441 A1 Mar. 28, 2019

Related U.S. Application Data

(60) Provisional application No. 62/562,727, filed on Sep. 25, 2017.

(51) Int. Cl.
*E21B 33/06* (2006.01)

(52) U.S. Cl.
CPC ..... *E21B 33/06* (2013.01); *E21B 33/061* (2013.01)

(58) Field of Classification Search
CPC ..... E21B 33/06; E21B 33/061
See application file for complete search history.

(56) References Cited

U.S. PATENT DOCUMENTS 665,073 A 1/1901 Doyle et al.
958,862 A 5/1910 Durham
1,517,504 A 12/1924 Hansen
1,517,540 A 12/1924 Hansen
1,891,417 A 12/1932 Heggem
2,059,798 A 11/1936 Kniss
(Continued)

FOREIGN PATENT DOCUMENTS

CA 2153612 2/1997
CA 2544718 11/2006
(Continued)

OTHER PUBLICATIONS

Search Report and Written Opinion for related PCT application PCT/CA2017/050161 dated Apr. 24, 2017 (7 pages).
(Continued)

*Primary Examiner* — Caroline N Butcher
(74) *Attorney, Agent, or Firm* — Schwegman Lundberg & Woessner, P.A.

(57) ABSTRACT

An adjustable blowout preventer may be configured to be adjustable, such that a central bore of the blowout preventer may be adjusted or repositioned. The blowout preventer may include one or more adjustment mechanisms for adjusting an angle of tilt of the central bore and/or an offset distance of the central bore. The adjustment mechanisms may be arranged between a stack of the blowout preventer and a wellhead. The adjustment mechanisms may generally be tubular structures having angled and/or laterally offset bores therein. The adjustment mechanisms may be configured to be rotatable, such that rotation of the mechanisms may change an angle of tilt and/or lateral offset of the blowout preventer central bore, or portions thereof.

12 Claims, 19 Drawing Sheets

(56) References Cited

U.S. PATENT DOCUMENTS

| | | | | |
|---|---|---|---|---|
| 2,237,709 | A | 4/1941 | Lowe | |
| 2,258,887 | A | 10/1941 | Fortune | |
| 2,573,832 | A | 11/1951 | Callahan | |
| 2,846,013 | A * | 8/1958 | Davis | E21B 33/03 166/97.5 |
| 3,084,946 | A | 4/1963 | Sharp | |
| 3,149,514 | A | 9/1964 | Shaub | |
| 3,186,722 | A | 6/1965 | Johnston | |
| 3,195,645 | A | 7/1965 | Doyle | |
| 3,651,717 | A | 3/1972 | Johnston | |
| 3,716,245 | A | 2/1973 | Turolla | |
| 3,796,103 | A | 3/1974 | Winfield | |
| 3,830,304 | A | 8/1974 | Cummins | |
| 4,071,085 | A | 1/1978 | Grable et al. | |
| 4,153,111 | A | 5/1979 | Lans et al. | |
| 4,407,510 | A | 10/1983 | Cornelius et al. | |
| 4,560,176 | A | 12/1985 | Hoff | |
| 4,580,762 | A | 4/1986 | Hirtz et al. | |
| 4,583,569 | A | 4/1986 | Ahlstone | |
| 4,613,140 | A | 9/1986 | Knox | |
| 4,716,970 | A | 1/1988 | Henning | |
| 4,777,849 | A | 10/1988 | Sears | |
| 4,865,245 | A | 9/1989 | Schulte et al. | |
| 4,889,184 | A | 12/1989 | Lugtmeier et al. | |
| 4,951,743 | A | 8/1990 | Henderson | |
| 5,257,812 | A | 11/1993 | Osorio et al. | |
| 5,400,857 | A | 3/1995 | Whitby et al. | |
| 5,408,901 | A | 4/1995 | Bishop | |
| 5,636,688 | A | 6/1997 | Bassinger | |
| 5,641,019 | A | 6/1997 | Stout et al. | |
| 5,711,533 | A | 2/1998 | Angelo et al. | |
| 5,791,411 | A | 8/1998 | Ricalton et al. | |
| 5,865,245 | A | 2/1999 | Trout et al. | |
| 6,176,466 | B1 | 1/2001 | Lam et al. | |
| 7,216,872 | B1 | 5/2007 | Shaw et al. | |
| 8,544,535 | B2 | 10/2013 | Cote et al. | |
| 8,631,861 | B1 | 2/2014 | Busch | |
| 8,746,345 | B2 | 6/2014 | Kotrla et al. | |
| 8,899,338 | B2 | 12/2014 | Elsayed et al. | |
| 9,188,122 | B1 | 11/2015 | Reed | |
| 9,702,203 | B2 | 7/2017 | Bolstad, Jr. | |
| 10,597,968 | B2 | 3/2020 | McAdam et al. | |
| 2003/0070806 | A1 | 4/2003 | Connell et al. | |
| 2003/0221844 | A1 | 12/2003 | Dallas | |
| 2006/0081368 | A1 | 4/2006 | Rosine et al. | |
| 2006/0124314 | A1 | 6/2006 | Haheim et al. | |
| 2008/0078558 | A1 | 4/2008 | Dallas | |
| 2009/0056930 | A1 | 3/2009 | Angelle et al. | |
| 2009/0260834 | A1 | 10/2009 | Henson et al. | |
| 2011/0168405 | A1* | 7/2011 | Parlee | E21B 23/00 166/379 |
| 2011/0198072 | A1 | 8/2011 | Cote et al. | |
| 2011/0203670 | A1 | 8/2011 | Braddick | |
| 2011/0266005 | A1 | 11/2011 | Hult et al. | |
| 2011/0278515 | A1 | 11/2011 | Perio | |
| 2012/0012339 | A1 | 1/2012 | Weir et al. | |
| 2012/0012340 | A1 | 1/2012 | Ensley et al. | |
| 2012/0024521 | A1 | 2/2012 | Villa | |
| 2012/0305102 | A1 | 12/2012 | Kukielka | |
| 2013/0126157 | A1 | 5/2013 | Farrar | |
| 2013/0126763 | A1 | 5/2013 | Guo et al. | |
| 2013/0147121 | A1 | 6/2013 | Xu | |
| 2013/0180733 | A1 | 7/2013 | Bradshaw et al. | |
| 2013/0199773 | A1 | 8/2013 | Tebay | |
| 2013/0327528 | A1 | 12/2013 | Frost | |
| 2013/0341045 | A1 | 12/2013 | Flusche | |
| 2015/0047858 | A1 | 2/2015 | Varkey et al. | |
| 2015/0218903 | A1 | 8/2015 | Sellers, Jr. et al. | |
| 2015/0285013 | A1* | 10/2015 | Johnson | E21B 33/06 166/381 |
| 2015/0300106 | A1 | 10/2015 | Martin et al. | |
| 2016/0251917 | A1 | 9/2016 | Harrell et al. | |
| 2017/0146007 | A1 | 5/2017 | Robison et al. | |
| 2017/0306745 | A1 | 10/2017 | Harding et al. | |
| 2018/0202254 | A1 | 7/2018 | Mcadam et al. | |
| 2019/0040696 | A1 | 2/2019 | Mcadam et al. | |
| 2019/0049017 | A1 | 2/2019 | Mcadam et al. | |
| 2019/0234167 | A1 | 8/2019 | Mcadam et al. | |
| 2019/0360299 | A1 | 11/2019 | Mcadam et al. | |
| 2020/0298385 | A1 | 9/2020 | Mcadam et al. | |

FOREIGN PATENT DOCUMENTS

| | | | |
|---|---|---|---|
| CA | 20509182 | | 12/2006 |
| CA | 2942857 | | 10/2015 |
| CA | 2991538 | A1 | 1/2017 |
| CA | 3013084 | A1 | 8/2017 |
| CN | 2567336 | | 8/2003 |
| CN | 202090881 | | 12/2011 |
| CN | 202731817 | | 2/2013 |
| GB | 2206932 | | 2/1989 |
| WO | WO-2017004696 | A1 | 1/2017 |
| WO | WO-2018018142 | A1 | 2/2018 |
| WO | WO-2018049503 | A1 | 3/2018 |
| WO | WO-2018129620 | A1 | 7/2018 |
| WO | WO-2018213918 | A1 | 11/2018 |
| WO | WO-2019056088 | A1 | 3/2019 |

OTHER PUBLICATIONS

Search Report and Written Opinion for related PCT application PCT/CA2017/050890 dated Oct. 17, 2017 (7 pages).

Search Report and Written Opinion for related PCT application PCT/CA2017/050963 dated Nov. 8, 2017 (8 pages).

International Search Report and Written opinion for related PCT application PCT/CA2016/051532 dated Jan. 23, 2017 (8 pages).

International Search Report and Written Opinion for related PCT Application No. PCT/CA2018/050025 dated Apr. 4, 2018 (8 pages).

International Search Report and Written Opinion for PCT Application No. PCT/CA2016/050373 dated May 30, 2016 (7 pages).

International Search Report and Written Opinion for related PCT Application No. PCT/CA2018/000101 dated Oct. 26, 2018 (9 pages).

"International Application Serial No. PCT/CA2018/000179, International Search Report dated Dec. 21, 2018", 3 pgs.

"International Application Serial No. PCT/CA2018/000179, Receipt of Demand mailed Jul. 31, 2019", 1 pg.

"International Application Serial No. PCT/CA2018/000179, Response filed Jul. 25, 2019 to Written Opinion dated Dec. 21, 2018", 5 pgs.

"International Application Serial No. PCT/CA2018/000179, Written Opinion dated Dec. 21, 2018", 4 pgs.

"U.S. Appl. No. 15/742,632, Corrected Notice of Allowability dated Jan. 21, 2020", 2 pgs.

"U.S. Appl. No. 15/742,632, Non Final Office Action dated Jun. 26, 2019", 13 pgs.

"U.S. Appl. No. 15/742,632, Notice of Allowance dated Nov. 14, 2019", 5 pgs.

"U.S. Appl. No. 15/742,632, Preliminary Amendment filed Jan. 8, 2018", 3 pgs.

"U.S. Appl. No. 15/742,632, Response filed Oct. 28, 2019 to Non-Final Office Action dated Jun. 26, 2019", 9 pgs.

"U.S. Appl. No. 15/989,877, Examiner Interview Summary dated Aug. 18, 2020", 3 pgs.

"U.S. Appl. No. 15/989,877, Final Office Action dated Jun. 1, 2020", 18 pgs.

"U.S. Appl. No. 15/989,877, Non Final Office Action dated Dec. 6, 2019", 17 pgs.

"U.S. Appl. No. 15/989,877, Response filed Mar. 6, 2020 to Non Final Office Action dated Dec. 6, 2019", 9 pgs.

"U.S. Appl. No. 16/076,574, Examiner Interview Summary dated Jun. 12, 2020", 3 pgs.

"U.S. Appl. No. 16/076,574, Non Final Office Action dated Apr. 2, 2020", 7 pgs.

"U.S. Appl. No. 16/076,574, Response filed Jul. 2, 2020 to Non Final Office Action dated Apr. 2, 2020", 10 pgs.

"U.S. Appl. No. 16/316,661, Notice of Allowance dated Jun. 17, 2020" 9 pgs.

"U.S. Appl. No. 16/316,661, Preliminary Amendment filed Jan. 10, 2019", 5 pgs.

(56) References Cited

OTHER PUBLICATIONS

"U.S. Appl. No. 16/478,061, Non Final Office Action dated Aug. 5, 2020", 15 pgs.
"U.S. Appl. No. 16/478,061, Preliminary Amendment filed Jul. 15, 2019", 8 pgs.
"International Application Serial No. PCT/CA2016/050373, International Preliminary Report on Patentability dated Jan. 18, 2018", 6 pgs.
"International Application Serial No. PCT/CA2016/051532, International Preliminary Report on Patentability dated Mar. 28, 2019", 7 pgs.
"International Application Serial No. PCT/CA2017/050161, International Preliminary Report on Patentability dated Aug. 14, 2018", 5 pgs.
"International Application Serial No. PCT/CA2017/050890, International Preliminary Report on Patentability dated Feb. 7, 2019", 7 pgs.
"International Application Serial No. PCT/CA2018/000101, International Preliminary Report on Patentability dated Dec. 5, 2019", 6 pgs.
"International Application Serial No. PCT/CA2018/000179, International Preliminary Report on Patentability dated Dec. 12, 2019", 8 pgs.
"International Application Serial No. PCT/CA2018/050025, International Preliminary Report on Patentability dated Jul. 25, 2019", 6 pgs.
"KH2030 20mm Ball Bushing 20x28x30 Linear Motion Bearing", VXB.com Bearings, [Online]. Retrieved from the Internet: <URL: http://www.vxb.com/KH2030-20mm-Ball-Bushing-20x28x30-Linear-Motion-p/Kit7140.htm?gclid=EAIaIQobChMIsda3qpOc2wIVAtvACh1MIwBVEAYYBSABEgK7HvD_BwE, (accessed May 14, 2020), 7 pgs.
"Pro Align (Opal)", Bell Industries A Division of Bell Envirotech Inc., [Online]. Retrieved from the Internet: <URL: http://bellindustries.ca/index.php/gallery1/harbison-fiseher/pro-align>, (2020), 2 pgs.
"Pro Align (Opal)", Harbison-Fischer Well Head Tools, (2020), 1 pg.
"Rod String", Dynatec International Ltd., [Online], Retrieved from the Internet: <URL: https://protect-us.mimecast.com/s/0F_HC9rOL0HkW2oNHODTVr?domain=nelgarservices.com>, (2012), 1 pg.
"Rod-Knuckle Environmental Bob Stuffing Box", Nelgar Services Inc., [Online]. Retrieved from the Internet: <URL: https://protect-us.mimecast.com/s/0F_HC9rOL0HkW2oNHODTVr?domain=nelgarservices.com>, (2017), 4 pgs.
"Rod-Pump Accessories", Apergy Artificial Lift Technologies, [Online]. Retrieved from the Internet: <URL: https://apergyals.com/products/rod-lift/harbison-fischer/rod-pump-accessories/>, (2020), 11 pgs.
"The Weekly Screw", The Virtual Corkscrew Museum's Weekly Newspaper No. 469, [Online]. [Accessed Nov. 8, 2018]. Retrieved from the Internet: <URL: http://www.bullworks.net/daily/20070722.htm>, (Jul. 22, 2007), 14 pgs.
"Wellhead Accessories", Apergy Artificial Lift Technologies, [Online]. Retrieved from the Internet: <URL: https://apergyals.com/products/rod-lift/harbison-fischer/wellhead-accessories>, (2020), 7 pgs.
"U.S. Appl. No. 15/989,877, Response filed Sep. 1, 2020 to Final Office Action dated Jun. 1, 2020".
"U.S. Appl. No. 16/316,661, Notice of Allowance dated Sep. 17, 2020", 8 pgs.
"U.S. Appl. No. 16/316,661, Supplemental Notice of Allowability dated Sep. 30, 2020", 2 pgs.
"U.S. Appl. No. 15/989,877, Non Final Office Action dated Oct. 1, 2020", 19 pgs.
"U.S. Appl. No. 16/076,574, Notice of Allowance dated Oct. 15, 2020", 7 pgs.

* cited by examiner

ADJUSTABLE BLOWOUT PREVENTER AND METHODS OF USE

CROSS-REFERENCE TO RELATED APPLICATIONS

The present application claims priority to U.S. Provisional Application No. 62/562,727, filed on Sep. 25, 2017, entitled Adjustable Blowout Preventer and Methods of Use, the content of which is hereby incorporated by reference herein in its entirety.

FIELD

Embodiments herein generally relate to well production equipment, and in particular to an adjustable blowout preventer for accommodating rod string offset in horizontal drilling operations.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Downhole reciprocating pumps may be positioned in a wellbore and actuated by a rod string extending from a pump jack at the surface and downward through the co-axially aligned central bores of various wellhead components (e.g. stuffing box, blowout preventers, etc). The rod string may be a continuous member or a plurality of sucker rods connected end-to-end, It is not uncommon for misalignment of the rod string or the wellhead components to occur, either one from the other, or from the longitudinal axis of the wellbore itself. Misalignment may be caused by normal usage, through damage, or through wear or stress on the system. For example, when the overhead pump jack is not perfectly centered over the wellhead components, it may pull the rod string or a portion thereof off-center. Moreover, the action of the pump jack may be along a radius and, as such, may not pull completely parallel to the rod at all times. Still other factors may contribute to misalignment of the rod and/or wellhead components, the other mentioned devices, or other systems.

Such misalignment may cause excessive and uneven wear to one or more sides of the tubular along the wellhead components, such side loading causing damage to the rod. Moreover, even where the rod string may be aligned with the axis of the wellbore, the casing head connected to the top of the casing at the wellhead can be uneven, resulting in misalignment at the interface of the casing head with the wellhead components extending thereabove.

SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to an adjustable blowout preventer for arranging over a wellhead. The blowout preventer may include a stack having at least one pipe ram, a central bore extending through the blowout preventer, and an adjustment portion configured to be arranged between the stack and the wellhead. The adjustment portion may include at least one adjustment mechanism for adjusting an alignment of the central bore. In some embodiments, the adjustment mechanism(s) may include a rotatable tilting coupler for adjusting an angle of tilt of the central bore and a rotatable offset collar for adjusting an offset distance of the central bore. In some embodiments, the tilting coupler may include a tubular member having a lower bore portion having a first longitudinal axis and an upper bore portion having a second longitudinal axis angled away from the first axis. The second longitudinal axis may be angled away from the first longitudinal axis by an angle of less than 10 degrees in some embodiments. The offset collar may include a tubular member having a lower bore portion with a first longitudinal axis and an upper bore portion with a second longitudinal axis. At least one of the first and second longitudinal axes of the offset collar may be laterally offset from a central axis of the offset collar. Additionally, at least one of the first and second longitudinal axes of the collar may be offset from a central axis of the offset collar by a distance of less than four inches. In some embodiments, the blowout preventer may additionally have a second rotatable tilting coupler and a second rotatable offset collar. Moreover, the blowout preventer may have a tilt gauge for identifying the angle of tilt and an offset gauge for identifying the offset distance.

The present disclosure, in one or more embodiments, additionally relates to an adjustment apparatus for adjusting a central bore of a blowout preventer. The adjustment apparatus may include at least one adjustment mechanism for adjusting an alignment of the central bore, the adjustment mechanism(s) configured to be arranged between a stack of the blowout preventer and a wellhead. The adjustment mechanism(s) may include a rotatable tilting coupler for adjusting an angle of tilt of the central bore and a rotatable offset collar for adjusting an offset distance of the central bore. In some embodiments, the tilting coupler may include a tubular member having a lower bore portion having a first longitudinal axis and an upper bore portion having a second longitudinal axis angled away from the first axis. The second longitudinal axis may be angled away from the first longitudinal axis by an angle of less than 10 degrees in some embodiments. The offset collar may include a tubular member having a lower bore portion with a first longitudinal axis and an upper bore portion with a second longitudinal axis. At least one of the first and second longitudinal axes of the offset collar may be laterally offset from a central axis of the offset collar. Additionally, at least one of the first and second longitudinal axes of the collar may be offset from a central axis of the offset collar by a distance of less than four inches. The adjustment apparatus may have a second rotatable tilting coupler and a second rotatable offset collar. Additionally, the adjustment apparatus may have a tilt gauge for identifying the angle of tilt and an offset gauge for identifying the offset distance.

The present disclosure, in one or more embodiments, additionally relates to, a method of adjusting a central bore of a blowout preventer. The method may include adjusting an angle of tilt of the central bore and adjusting an offset distance of the central bore. Adjusting an angle of tilt may include rotating a tilting coupler arranged between a stack of the blowout preventer and a wellhead, the tilting coupler having a tubular member with a lower bore portion and an upper bore portion. The lower bore portion may have a first longitudinal axis and the upper bore portion may have a second longitudinal axis angled away from the first longitudinal axis. Adjusting an offset distance of the central bore may include rotating an offset collar arranged between a stack of the blowout preventer and a wellhead, the offset collar having a tubular member with a lower bore portion and an upper bore portion. The lower bore portion may have a first longitudinal axis, and the upper bore portion may have a second longitudinal axis. At least one of the longitudinal axes of the offset collar may be laterally offset from a central axis of the offset collar. In some embodiments, the method may additionally include aligning the blowout preventer. Aligning the blowout preventer may include rotating an offset collar arranged between a stack of the blowout preventer and a wellhead, the offset collar including a tubular member with a lower bore portion and an upper bore portion. The lower bore portion may have a first longitudinal axis and the upper bore portion may have a second longitudinal axis. At least one of the first and second longitudinal axes may be laterally offset from a central axis of the offset collar.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present application, in one or more embodiments, relates to systems and methods for aligning a central bore of a blowout preventer with a rod string and/or with other wellhead components. In conventional oil and gas drilling operations, it is desirable for the longitudinal axis of the wellbore to be aligned with the wellhead components affixed to the casing head welded to the top of the casing at the wellhead, as well as the rod string reciprocating therethrough. Problems arise when either the rod string or the wellhead components become misaligned. Herein, an adjustable blowout preventer and methods of use are provided, wherein the blowout preventer can resolve and/or accommodate both axial misalignment of the rod string and lateral offset of the wellhead components, preventing or mitigating damage (e.g. side loading) to the rod string and wellhead components.

A blowout preventer of the present disclosure may be configured to be adjustable, such that a central bore of the blowout preventer may be adjusted or repositioned. In particular, a blowout preventer of the present disclosure may have one or more adjustment mechanisms for adjusting an angle of tilt of the central bore and/or an offset distance of the central bore. The adjustment mechanisms may be arranged between a stack of the blowout preventer and a wellhead. The adjustment mechanisms may generally be tubular structures having angled and/or laterally offset bores therein. The adjustment mechanisms may be configured to be rotatable, such that rotation of the mechanisms may change an angle of tilt and/or lateral offset of the blowout preventer central bore, or portions thereof.

Figure 1:
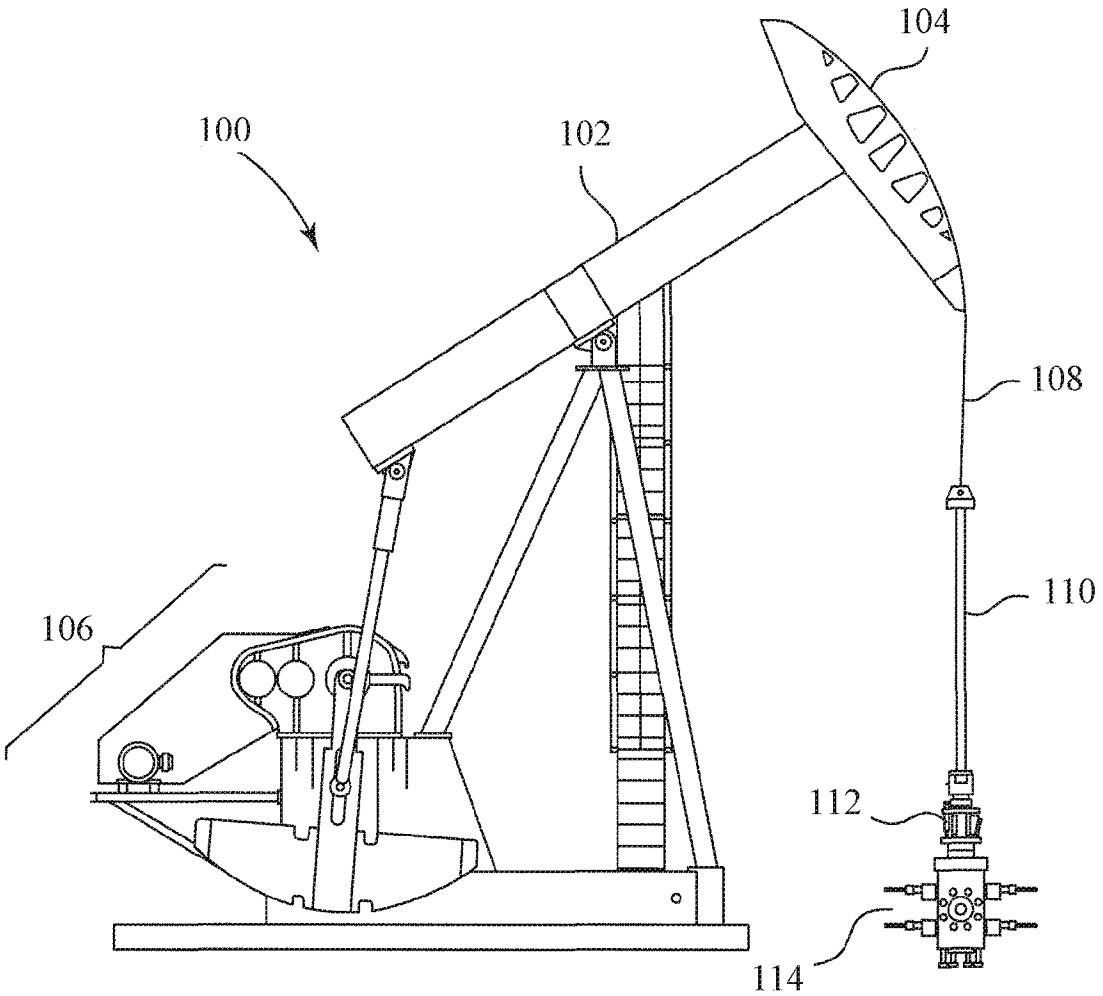
FIG. 1 is a side view of a pump jack having a rod string extending through an adjustable blowout preventer, according to one or more embodiments.

Referring now to FIG. 1, a pump jack system 100 is shown including a pivoting beam 102, a head portion 104, and an articulation mechanism 106. A bridle 108 may extend from the head of the pump jack down to a rod string 110, which may extend further downward through a stuffing box 112 and an adjustable blowout preventer 114, and into a wellbore. As may be appreciated, the articulation mechanism 106 may function to articulate the pivoting beam 102, which may function to drive and/or pull the rod string 110 into and out of the wellbore. As described in more detail below, the adjustable blowout preventer may be used to address misalignment that may occur between the rod string and the blowout preventer, other wellhead components, and/or the wellhead.

In some embodiments, an adjustable blowout preventer of the present disclosure may be used in conjunction or connection with rod alignment apparatuses and systems, such as those described in U.S. patent application Ser. No. 15/989,877, filed May 25, 2018, and entitled Method and Apparatus for Rod Alignment, the content of which is hereby incorporated by reference herein in its entirety.

Figure 2:
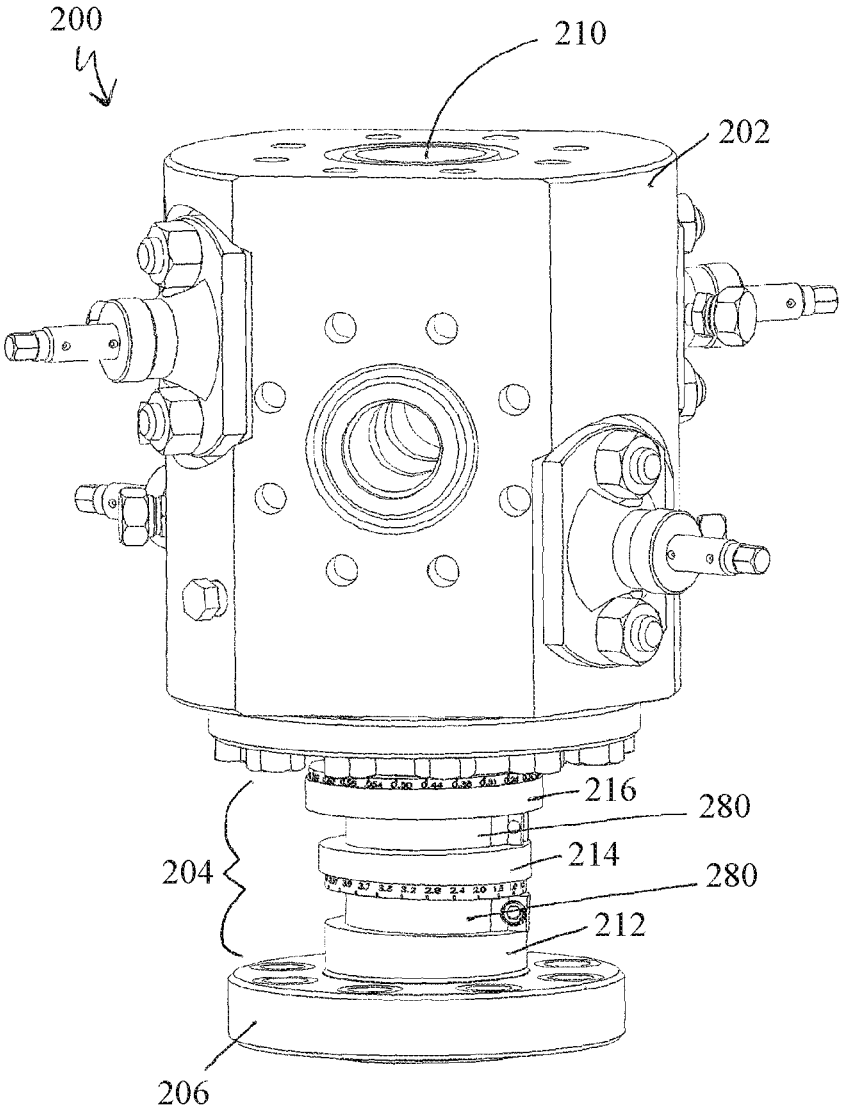
FIG. 2 is a perspective side view of an adjustable blowout preventer, according to one or more embodiments.

Turning now to FIG. 2, an adjustable blowout preventer (BOP) 200 of the present disclosure is shown, according to one or more embodiments. The blowout preventer 200 may be a service BOP or a production BOP. The blowout preventer 200 may be configured to be arranged above, or at the surface of, a wellhead. In some embodiments, the BOP may have one ram, or may have two rams. Additionally, the BOP may have a flow line connector, or may have a flow tee. The blowout preventer 200 may be configured to receive a rod string extending therethrough to reach the well. The blowout preventer 200 may be configured to accommodate a reciprocating and/or rotating rod string, for example. The blowout preventer 200 may further be configured to be coupled to a casing head at a wellhead. The blowout preventer 200 may generally have a stack 202 and a casing head connector plate 206. The stack 202 may include one, two, three, or any other suitable number of pipe rams. The casing head connector plate 206 may be configured for coupling the blowout preventer 200 to a casing head over a wellbore. The casing head connector plate 206 may be bolted to the casing head, for example. The blowout preventer 200 may have an adjustment portion 204 arranged between the stack 202 and casing head connector plate 206. Additionally, the blowout preventer 200 may have a central bore 210 extending through the stack 202, adjustment portion 204, and connector plate 206, and configured for receiving a rod string.

Figure 3:
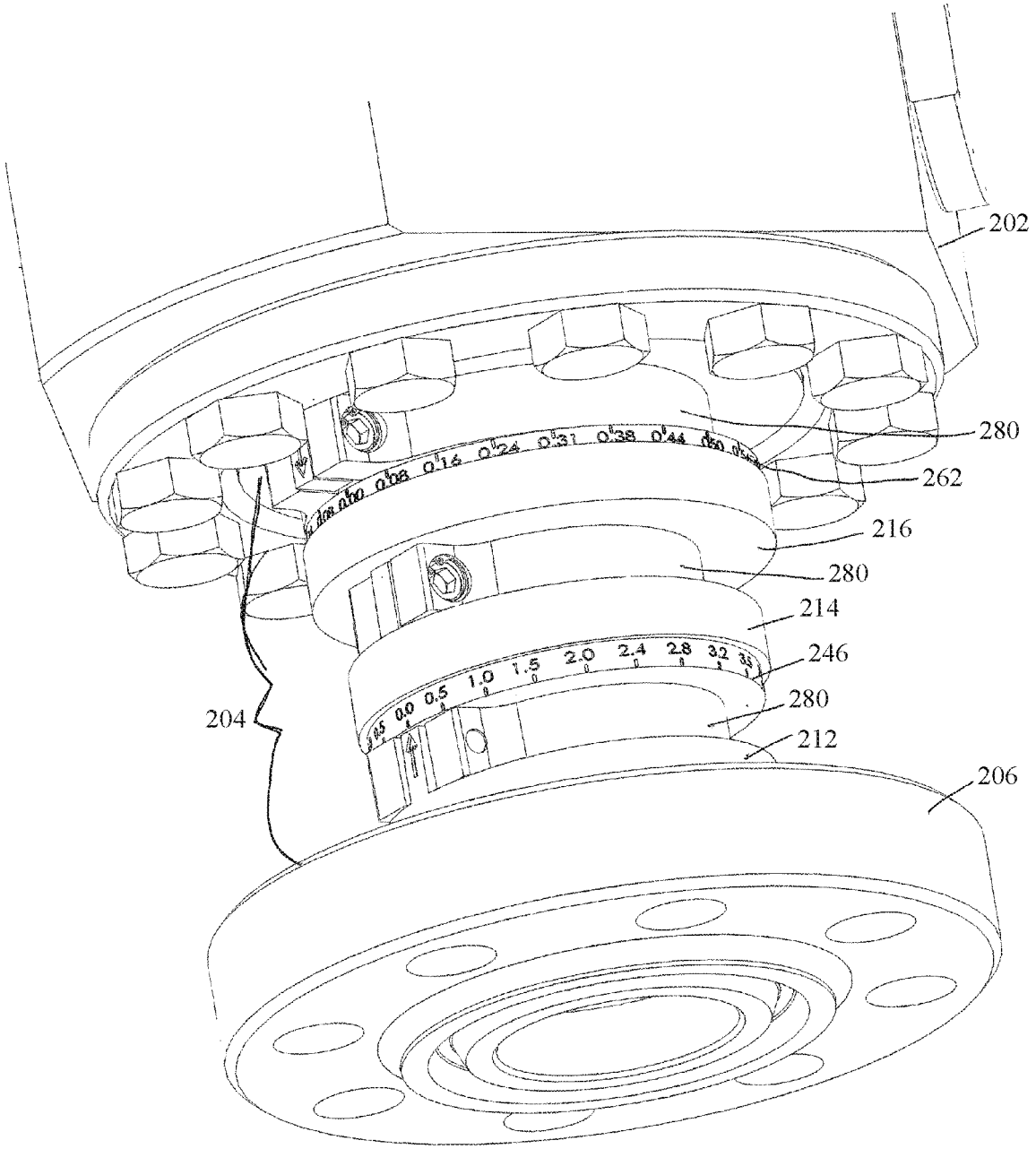
FIG. 3 is a perspective side view of an adjustment portion of the adjustable blowout preventer of FIG. 2, according to one or more embodiments.
Figure 4:
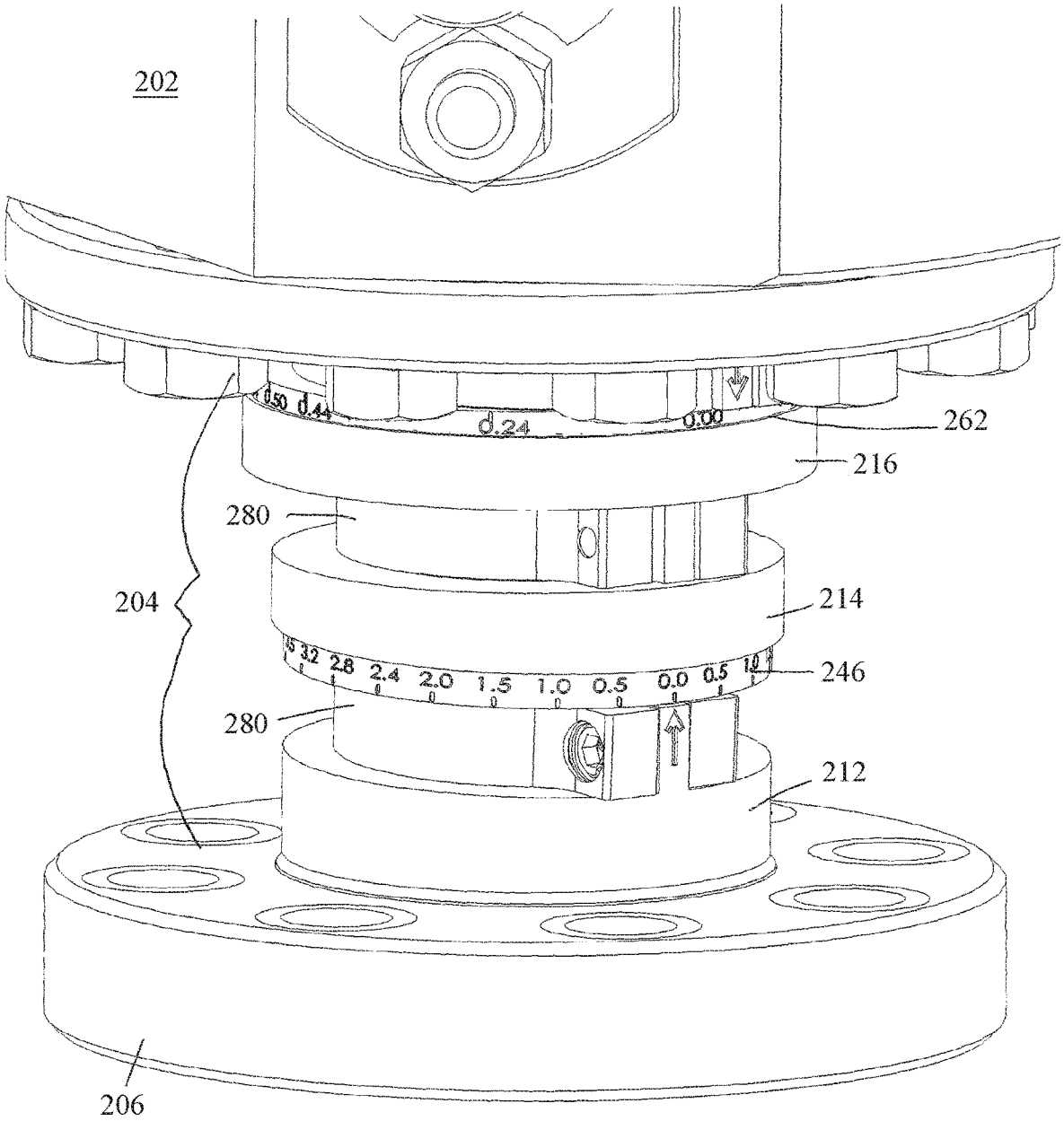
FIG. 4 is a side view of the adjustment portion of the adjustable blowout preventer of FIG. 2, according to one or more embodiments.
Figure 5:
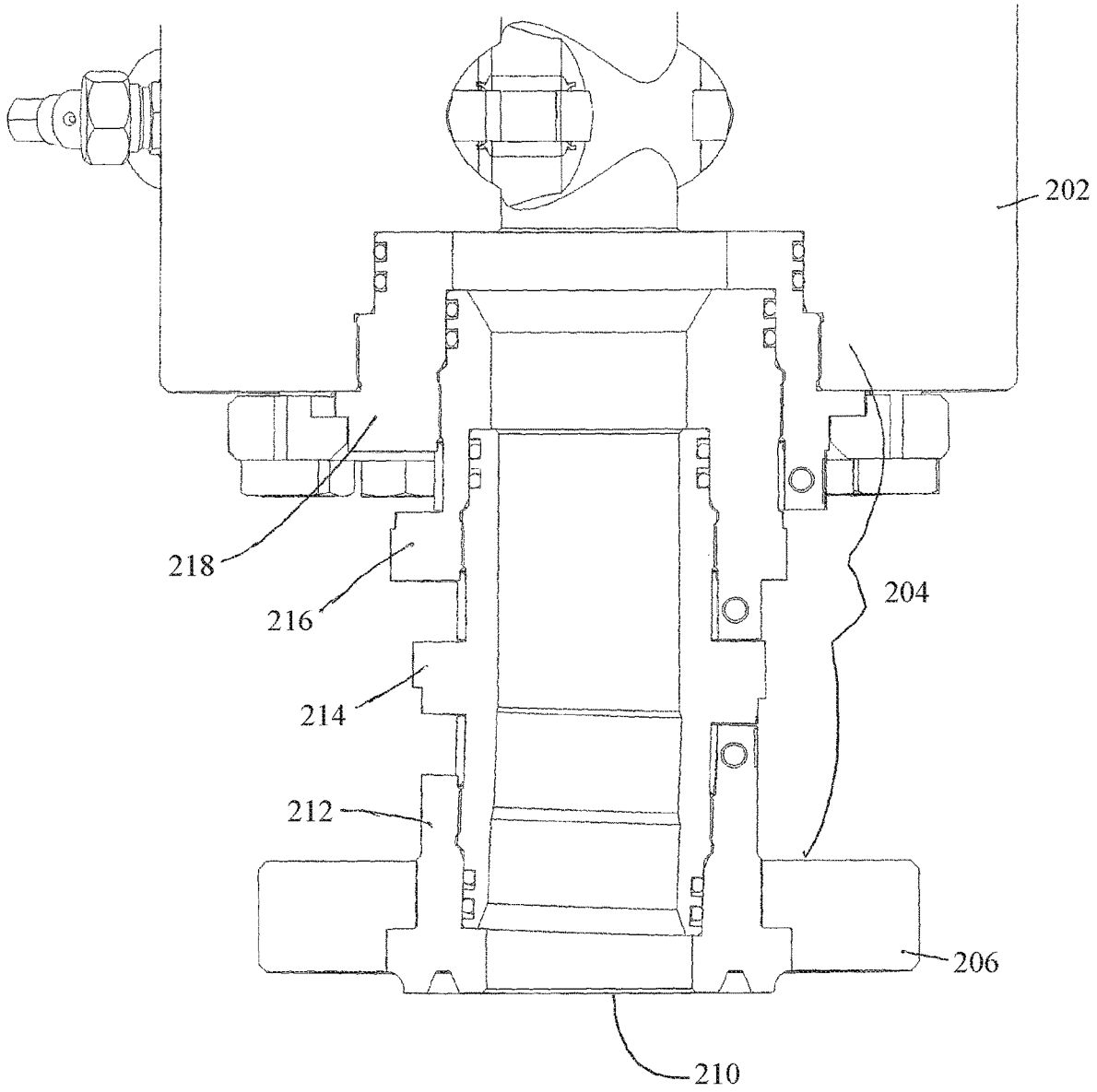
FIG. 5 is a cross-sectional view of the adjustment portion of the adjustable blowout preventer of FIG. 2, according to one or more embodiments.

FIGS. 3 and 4 show additional views of the adjustment portion 204, and FIG. 5 shows a cross-sectional view of the adjustment portion. As shown in FIG. 5, the central bore 210 of the blowout preventer 200 may extend through the adjustment portion 204. The adjustment portion 204 may have one or more adjustment members configured for adjusting the central bore 210. In particular, the one or more adjustment members may be configured for repositioning or adjusting a longitudinal axis of the central bore 210, or a portion thereof, so as to coaxially align the central bore with a longitudinal axis of the rod string. Such adjustment to the central bore 210 may be configured to compensate for or accommodate misalignment between the central bore and the rod string. In some embodiments, one or more adjustment members may be or include a tilting coupler 212, 214, configured to adjust an angle of tilt of the central bore 210, or a portion thereof. Additionally or alternatively, one or more adjustment members may be or include an offset collar 216, 218 configured to adjust an offset distance of the central bore 210, or a portion thereof. In at least one embodiment, the adjustment portion 204 may have a first tilting coupler 212, a second tilting coupler 214, a first offset collar 216, and a second offset collar 218. However, in other embodiments, the adjustment portion 204 may have more or fewer tilting couplers and/or offset collars.

The tilting couplers 212, 214 may be configured to adjust an angle of tilt of a longitudinal axis of the central bore 210 of the BOP 200. In particular, each tilting coupler 212, 214 may have a bore arranged therein with a longitudinal axis angled or tilted away from a central longitudinal axis of the coupler. Rotation of one or both couplers 212, 214 may cause the central bore 210, or a portion thereof, to tilt or pivot away from or toward vertical.

Figure 6:
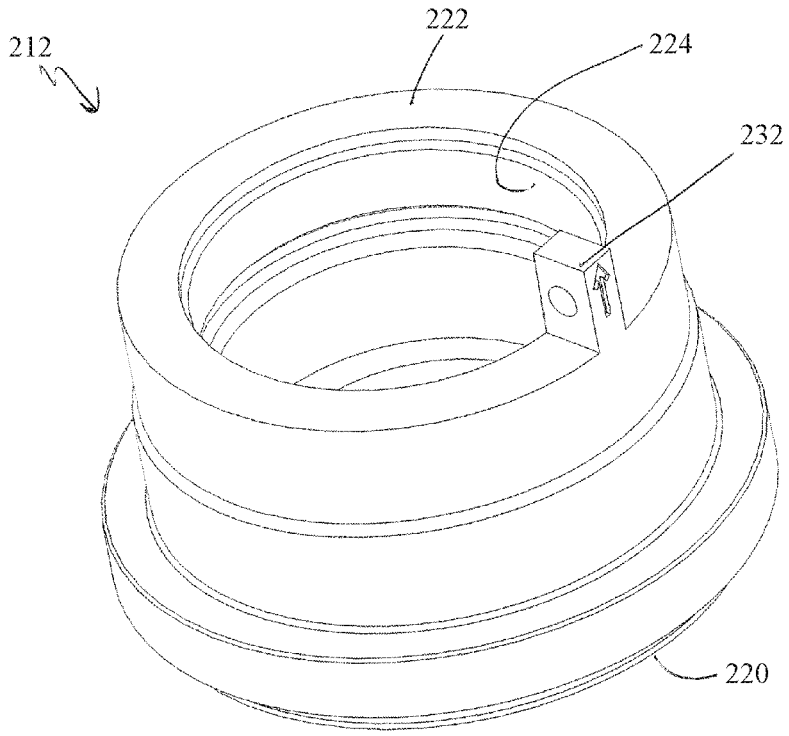
FIG. 6 is a perspective view of a first tilting coupler of an adjustable blowout preventer adjustment portion, according to one or more embodiments.
Figure 7:
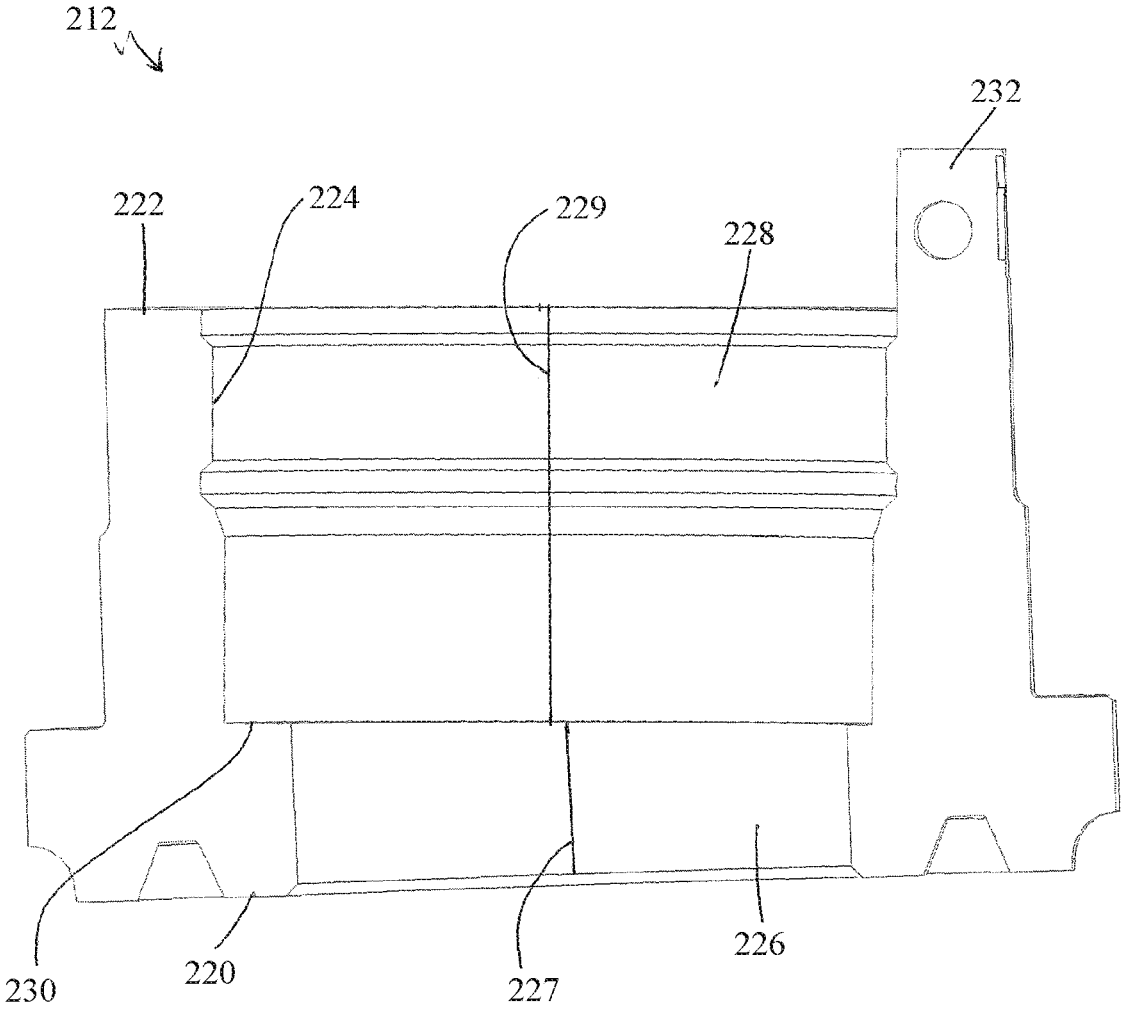
FIG. 7 is a cross-sectional view of the first tilting coupler of FIG. 6, according to one or more embodiments.

FIGS. 6 and 7 illustrate the first tilting coupler 212, according to at least one embodiment. The first tilting coupler 212 may include a tubular member having a cylindrical shape extending between a first end 220 and a second end 222. The first tilting coupler 212 may be configured to be arranged between the casing head connector plate 206 (or another component of the wellhead) and the second tilting coupler 214. The first tilting coupler 212 may additionally have an inner wall 224 defining a generally circular bore extending through the coupler between the first 220 and second 222 ends.

As shown particularly in FIG. 7, the first tilting coupler 212 may have a first inner bore 226, which may be a lower bore portion, and a second inner bore 228, which may be an upper bore portion. The lower bore portion 226 may be arranged proximate to the first end 220, and may be sized and configured to align with a bore extending through a casing head. The lower bore portion 226 may have a diameter of between approximately 1 inch and approximately 8 inches, or between approximately 2 inches and approximately 4 inches. In some embodiments, the lower bore portion 226 may have a diameter of approximately 3 inches, 3.25 inches, 3.5 inches, or 3.75 inches. The lower bore portion 226 may have a length, extending upward from the first end 220 and perpendicular to the diameter, of between approximately 0.25 inches and approximately 3 inches, or between approximately 0.5 inches and approximately 1.5 inches. In some embodiments, the lower bore portion 226 may have a length of approximately 0.9 inches, 1 inch, 1.2 inches, or 1.25 inches. In other embodiments, the lower bore portion 226 may have any other suitable diameter and length. The upper bore portion 228 may be arranged proximate to the second end 222, and may be sized and configured to align with a bore extending through the second tilting coupler 214. The upper bore portion 228 may have a diameter of between approximately 1.5 inches and approximately 10 inches, or between approximately 3 inches and approximately 5 inches. In some embodiments, the upper bore portion 228 may have a diameter of approximately 3.5 inches, 3.75 inches, 4 inches, 4.25 inches, or 4.5 inches. The upper bore portion 228 may have a length, extending from the second end 222 and perpendicular to the diameter, of between approximately 0.5 inches and approximately 6 inches, or between approximately 1 inch and approximately 3 inches. In some embodiments, the upper bore portion 228 may have a length of approximately 2 inches, 2.1 inches, or 2.2 inches. In other embodiments, the upper bore portion 228 may have any other suitable diameter and length. In other embodiments, the first tilting coupler 212 may have more or fewer bore portions.

In some embodiments, the two bore portions 226, 228 may have different diameters. In particular, the upper and lower bore portions 228, 226 may be configured such that a smallest inner diameter of the bore portions may be arranged within the lower bore portion 226 at or near the first end 220, and a largest diameter may be arranged within the upper bore portion 228 at or near the second end 222.

Additionally, in some embodiments, one or both bore portions 226, 228 may have an angled or tilted longitudinal axis. In particular, a longitudinal axis of the upper bore portion 228 may be angled from a longitudinal axis of the lower bore portion 226. In at least one embodiment, as shown for example in FIG. 7, the lower bore portion 226 may have a first longitudinal axis 227 configured to be arranged vertically or perpendicular to the casing head when the first tilting coupler 212 is coupled to the casing head connector plate 206. The upper bore portion 228 may have a second longitudinal axis 229 tilted from the first axis 227 by an angle of between approximately 0.5 degrees and approximately 15 degrees. In some embodiments, the angle of tilt between the axes 227, 229 may be between approximately 1 degree and approximately 10 degrees, or between approximately 2.5 degrees and approximately 7.5 degrees, or of approximately 5 degrees. In other embodiments, the angle of tilt between the two axes 227, 229 may be any other suitable angle. It is to be appreciated that the inner wall 224 may define a ledge or step 230 between the two bore portions 226, 228. Due to the nature of the angular offset between the two bore portions 226, 228, the step 230 may have an asymmetrical width in some embodiments.

The first end 220 of the first tilting coupler 212 may be configured to couple to the casing head connector plate 206, or to another wellhead component. Any suitable coupling mechanism may be used. For example, in some embodiments, the first end 220 may have openings configured to receive bolts for bolting the coupler 212 to the connector plate 206.

The second end 222 of the first tilting coupler 212 may be configured to couple to the second tilting coupler 214, the connection to which is described in more detail below. In some embodiments, the upper bore portion 228 may be configured to receive an end of the second tilting coupler 214. For example, in some embodiments, upper bore portion 228 may have internal threading configured to engage with external threading of the second tilting coupler 214. In some embodiments, the second end 222 may have a tab 232 extending therefrom. The tab 232 may be configured to overlap an outer wall of the second tilting coupler 214. As shown for example in FIG. 3, the tab 232 may also be configured to engage a clamp 280 for locking the second tilting coupler 214 in a fixed rotational position relative to the first tilting coupler 212.

Figure 8:
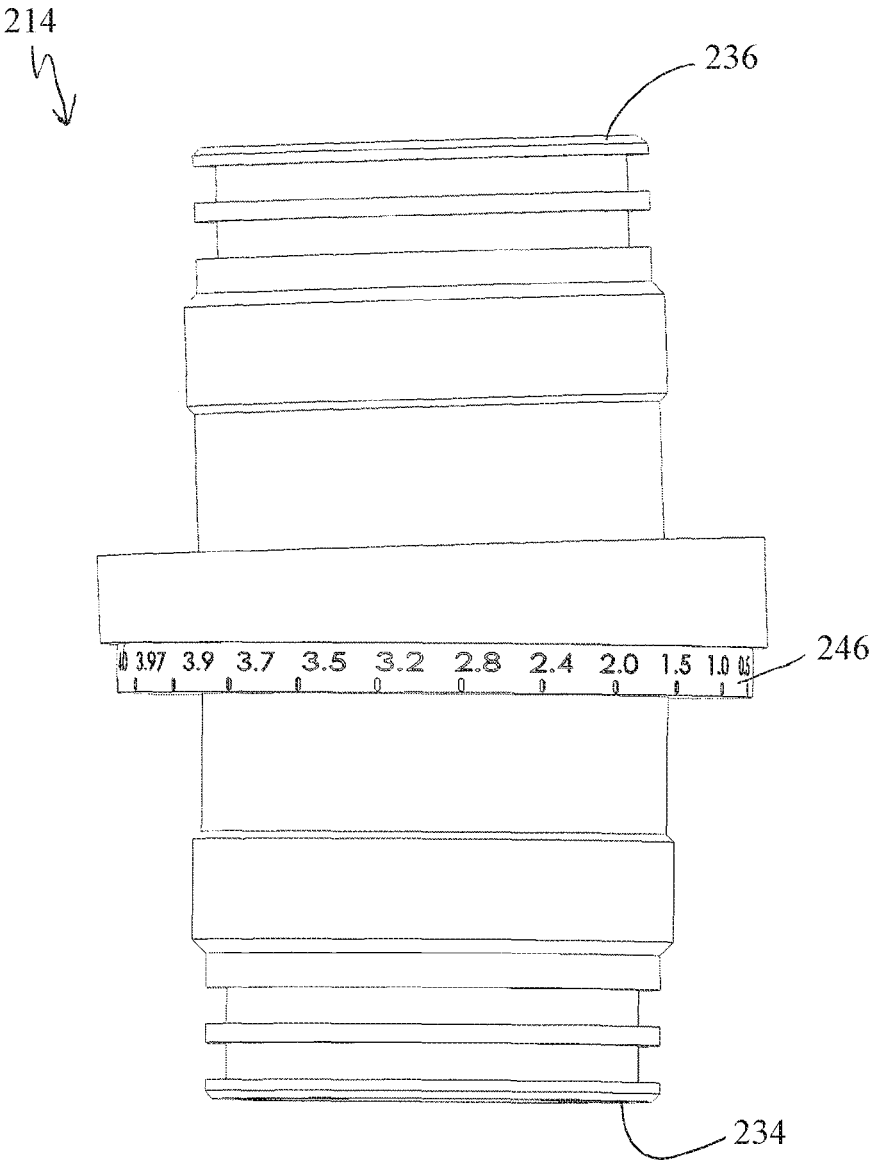
FIG. 8 is a side view of a second tilting coupler of an adjustable blowout preventer adjustment portion, according to one or more embodiments.
Figure 9:
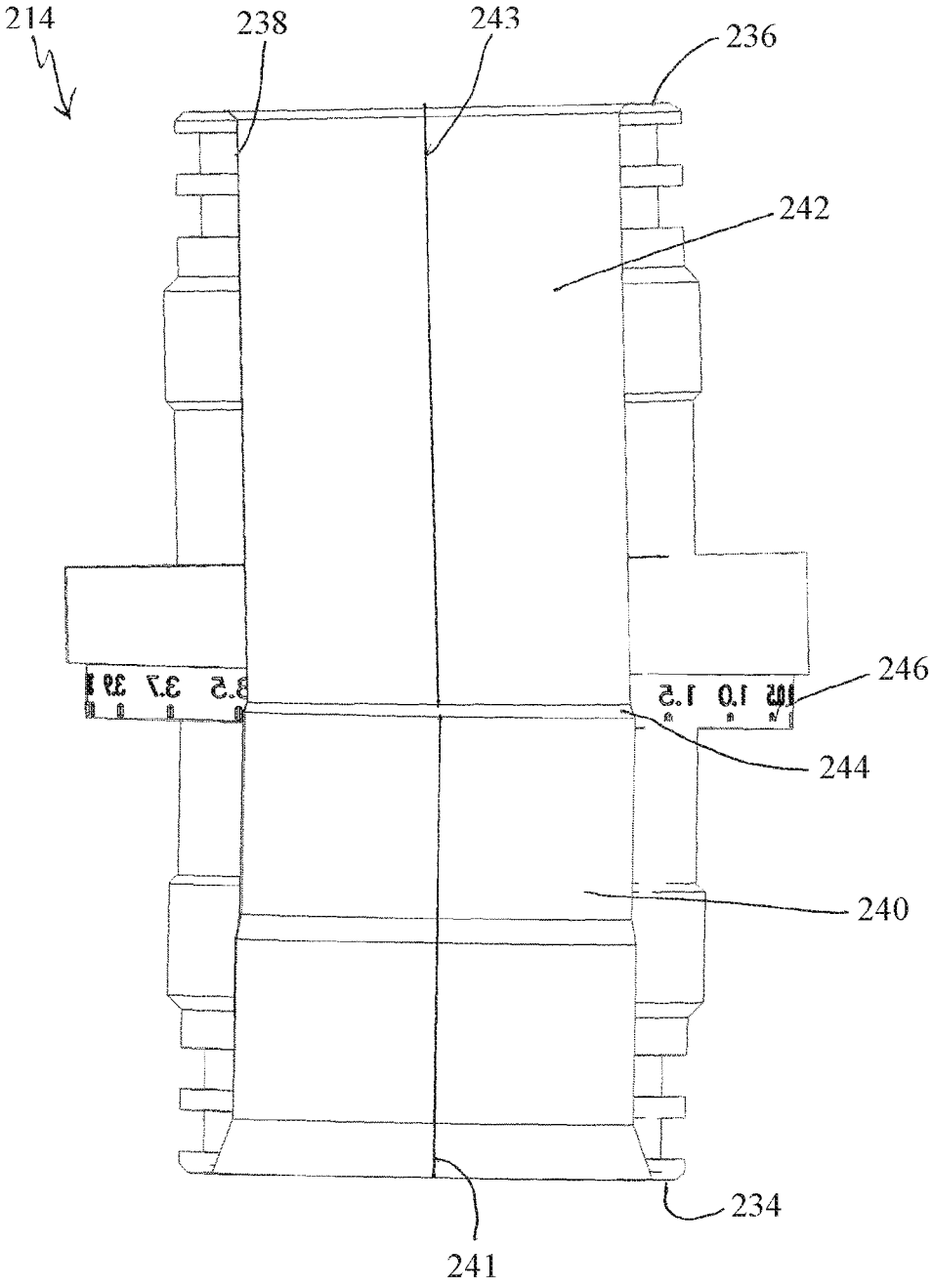
FIG. 9 is a cross-sectional view of the second tilting coupler of FIG. 8, according to one or more embodiments.

FIGS. 8 and 9 illustrate the second tilting coupler 214, according to at least one embodiment. The second tilting coupler 214 may include a tubular member having a cylindrical shape extending between a first end 234 and a second end 236. The second tilting coupler 214 may be configured to be arranged between the first tilting coupler 212 and the first offset collar 216. The second tilting coupler 214 may additionally have an inner wall 238 defining a generally circular bore extending through the coupler between the first 234 and second 236 ends.

As shown particularly in FIG. 9, the second tilting coupler 214 may have a first inner bore 240, which may be a lower bore portion, and a second inner bore 242, which may be an upper bore portion. The lower bore portion 240 may be arranged proximate to the first end 234, and may be sized and configured to align with the upper bore portion 228 of the first tilting coupler 212. The lower bore portion 240 may have a diameter of between approximately 1 inch and approximately 8 inches, or between approximately 2 inches and approximately 4 inches. In some embodiments, the lower bore portion 240 may have a diameter of approximately 2.7 inches, 2.8 inches, 3 inches, 3.2 inches, or 3.4 inches. The lower bore portion 240 may have a length, extending upward from the first end 234 and perpendicular to the diameter, of between approximately 1 inch and approximately 8 inches, or between approximately 2 inches and approximately 4 inches. In some embodiments, the lower bore portion 240 may have a length of approximately 3 inches, 3.1 inches, 3.2 inches, or 3.25. In other embodiments, the lower bore portion 240 may have any other suitable diameter and length. The upper bore portion 242 may be arranged proximate to the second end 236, and may be sized and configured to align with a bore extending through the first offset collar 216. The upper bore portion 242 may have a diameter of between approximately 1 inch and approximately 8 inches, or between approximately 2 inches and approximately 4 inches. In some embodiments, the lower bore portion 242 may have a diameter of approximately 2.6 inches, 2.8 inches, 3 inches, 3.2 inches, or 3.4 inches. The upper bore portion 242 may have a length, extending from the second end 236 and perpendicular to the diameter, of between approximately 1.5 inches and approximately 10 inches, or between approximately 3 inches and approximately 5 inches. In some embodiments, the upper bore portion 242 may have a length of approximately 4.25 inches, 4.3 inches, or 4.35 inches. In other embodiments, the lower bore portion 242 may have any other suitable diameter and length. In other embodiments, the second tilting coupler 214 may have more or fewer bore portions.

In some embodiments, the upper and/or lower bore portions 240, 242 may have an angled or tilted longitudinal axis. In particular, a longitudinal axis of the upper bore portion 242 may be angled from a longitudinal axis of the lower bore portion 240. In at least one embodiment, as shown for example in FIG. 9, the lower bore portion 240 may have a first longitudinal axis 241, and the upper bore portion 242 may have a second longitudinal axis 243 offset or tilted from the first axis 241 by an angle of between approximately 0.5 degrees and approximately 15 degrees. In some embodiments, the angle of tilt between the axes 241, 243 may be between approximately 1 degree and approximately 10 degrees, or between approximately 2.5 degrees and approximately 7.5 degrees, or of approximately 5 degrees. In other embodiments, the angle of tilt between the two axes 241, 243 may be any other suitable angle. It is to be appreciated that the inner wall 238 may define a ledge or step 244 between the two bore portions 240, 242. Due to the nature of the angular offset between the two bore portions 240, 242, the step 244 may have an asymmetrical width in some embodiments.

At the first end 234, the second tilting coupler 214 may be configured to couple to the first tilting coupler 212. Additionally, the second coupler 214 may be configured to rotate with respect to the first coupler 212. Any suitable coupling mechanisms may be used to allow the second coupler 214 to rotate with respect to the first coupler 212. In some embodiments, the two couplers 212, 214 may be configured to engage with one another using corresponding threading. For example, in some embodiments, the second tilting coupler 214 may have external threading arranged at the first end 234 for engaging with internal threading at the second end 222 of the first tilting coupler 212. Such threading may allow the second tilting coupler 214 to couple to the first coupler 212, and may additionally allow the second coupler to rotate with respect to the first coupler. It is to be appreciated that, due to the angled axis 229 of the upper bore portion 228 of the first coupler 212, the second coupler 214 may extend from the first coupler at a corresponding angle. In some embodiments, the second tilting coupler 214 may have ledges or ridges arranged at the first 234 end configured to receive one or more seal rings to seal the connection to the first tilting coupler 212.

Figure 16:
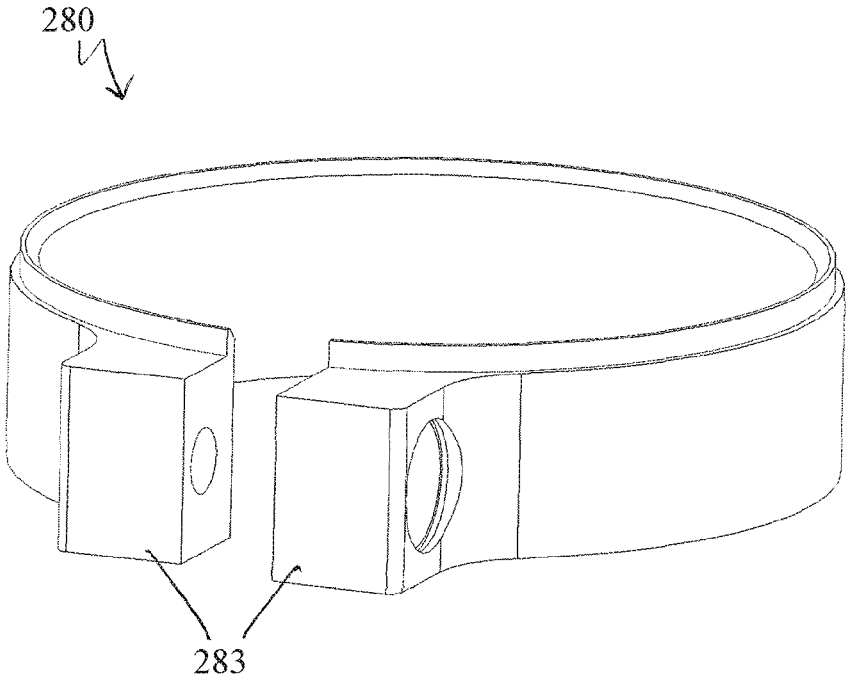
FIG. 16 is a perspective view of a clamp of an adjustable blowout preventer adjustment portion, according to one or more embodiments.

In some embodiments, a clamp 280 may be used to maintain the second tilting coupler 214 in a fixed rotational position with respect to the first tilting coupler 212. As shown particularly in FIG. 3, the clamp 280 may extend around an outer surface of the second coupler 214, and engage with the tab 232 of the first coupler to maintain the second coupler in a fixed rotational position. The clamp 280 is shown, according to some embodiments, in FIG. 16. As shown, the clamp 280 may be a pipe clamp with a circular shape sized and configured to extend around the second coupler. The clamp 280 may have two fasteners 283 configured to receive a tab, such as tab 232 of the first coupler 212 therebetween. A bolt may be arranged through the two fasteners 283 and the tab 232.

With reference back to FIGS. 8 and 9, the second end 236 of the second tilting coupler 214 may be configured to couple to the first offset collar 216, the connection to which is described in more detail below. In some embodiments, the second tilting coupler 214 may have ledges or ridges arranged at the second end 236 configured to receive one or more seal rings to seal the connection to the first offset collar 216.

In some embodiments, the second tilting coupler 214 may have a circular gauge 246 arranged about an outer surface of the coupler. The gauge 246 may be configured for identifying an amount or degree of tilt of the central bore 210 or a portion thereof. For example, the gauge may identify a degree of tilt of the central bore 210 based upon an angle between the lower 226 and upper 228 bore portions of the first tilting coupler 212, an angle between the lower 240 and upper 242 bore portions of the second tilting coupler 214, and a rotational position between the first and second tilting couplers. The gauge 246 may have numbers and corresponding dashes arranged thereon. The numbers and dashes may correspond to degrees of tilt. In some embodiments, the gauge 246 may identify a range of tilt angles from 0 degrees to approximately 10 degrees, or approximately 7.5 degrees, or approximately 5 degrees, or approximately 4 degrees, for example. The angle of tilt may correspond to a rotational position of the second tilting coupler 214 with respect to the first tilting coupler 214. For example, at 0 degrees on the gauge 246, the second coupler 214 may be rotationally positioned such that the angle of the upper bore portion 242 may counteract an angle of tilt introduced by the upper bore portion 228 of the first coupler 212. In this way, at a position of 0 degrees, the central bore 210 above the couplers 212, 214 may be coaxially aligned with a bore of the casing head or other wellhead components.

The gauge 246 may be fixed on the second tilting coupler 214, such that as the second tilting coupler rotates with respect to the first tilting coupler 212, the gauge will rotate with the second coupler. The first coupler 212 may have an arrow, line, or other marking arranged thereon configured to align with the gauge 246 to identify the angle of tilt. For example, as shown in FIG. 6, the tab 232 of the first tilting coupler 212 may have an arrow, line, or other marking arranged therein so as to designate an angle of tilt. It is to be appreciated that in other embodiments, the first coupler 212 may rotate with respect to the second coupler 214, and the gauge 246 may thus remain stationary with the second coupler to identify an angle of tilt. In still other embodiments, the gauge 246 may be arranged on the first tilting coupler 212 to identify the angle of tilt.

As indicated above, in addition to the tilting couplers 212, 214, the adjustable BOP 200 may have one or more offset collars, such as a first offset collar 216 and a second offset collar 218. Each offset collar 216, 218 may have a bore portion arranged therein with a laterally offset central axis. Rotation of one or both offset collars 216, 218 may cause a longitudinal axis of the central bore 210 to shift laterally so as to facilitate coaxial alignment with a rod string.

Figure 10:
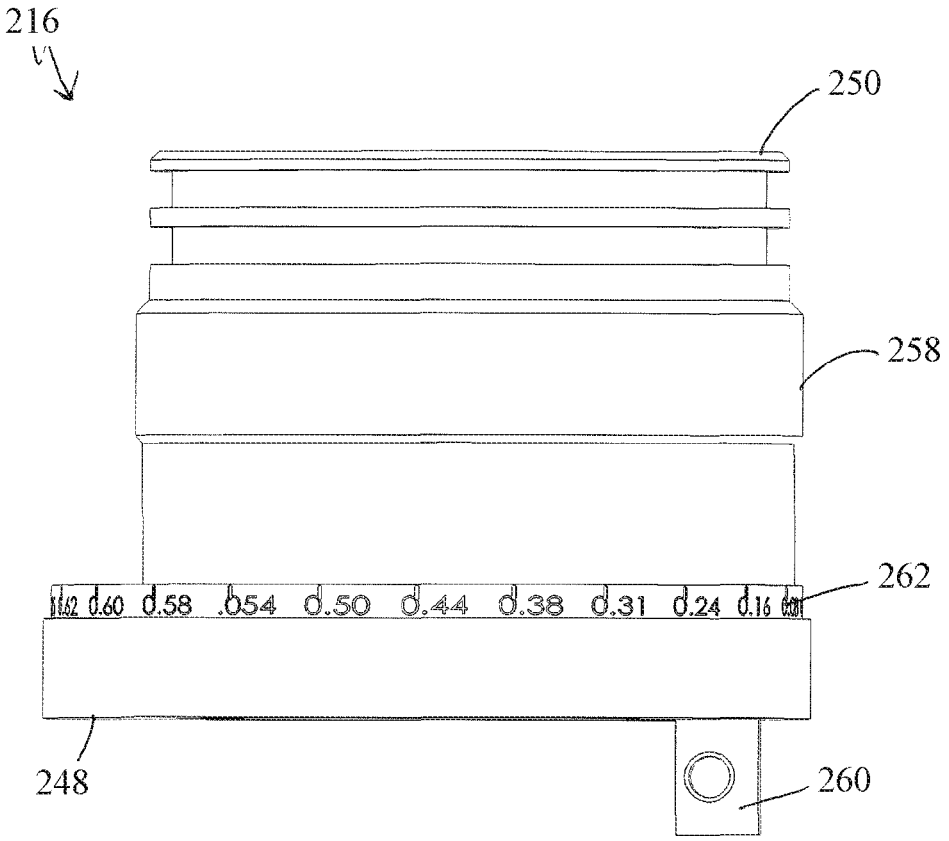
FIG. 10 is a side view of a first offset collar of an adjustable blowout preventer adjustment portion, according to one or more embodiments.
Figure 11:
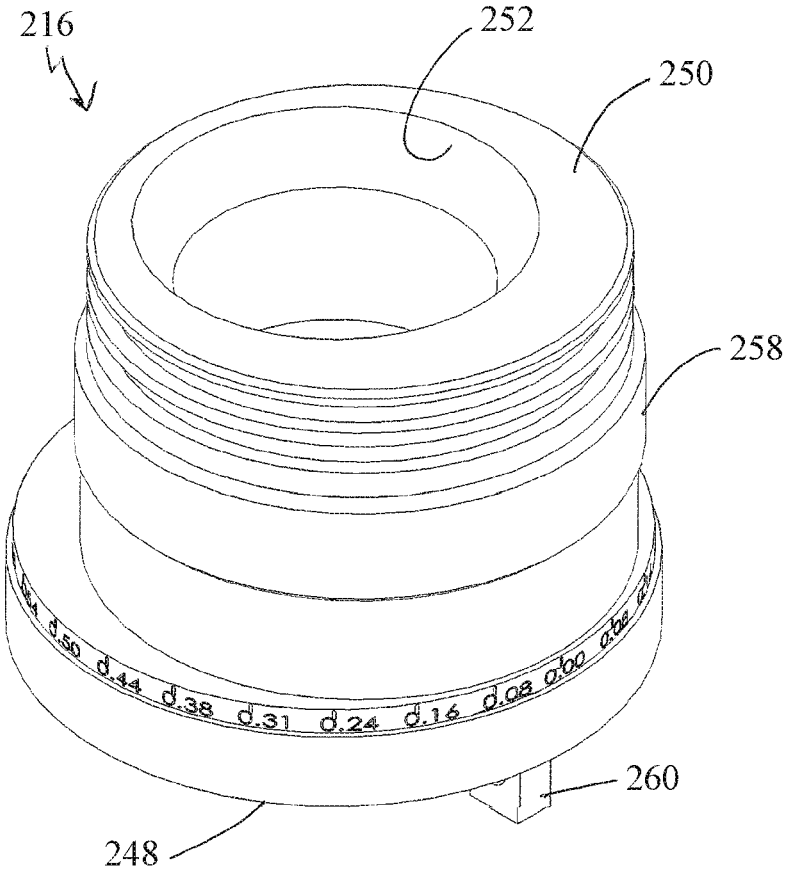
FIG. 11 is a perspective view of the first offset collar of FIG. 10, according to one or more embodiments.
Figure 12:
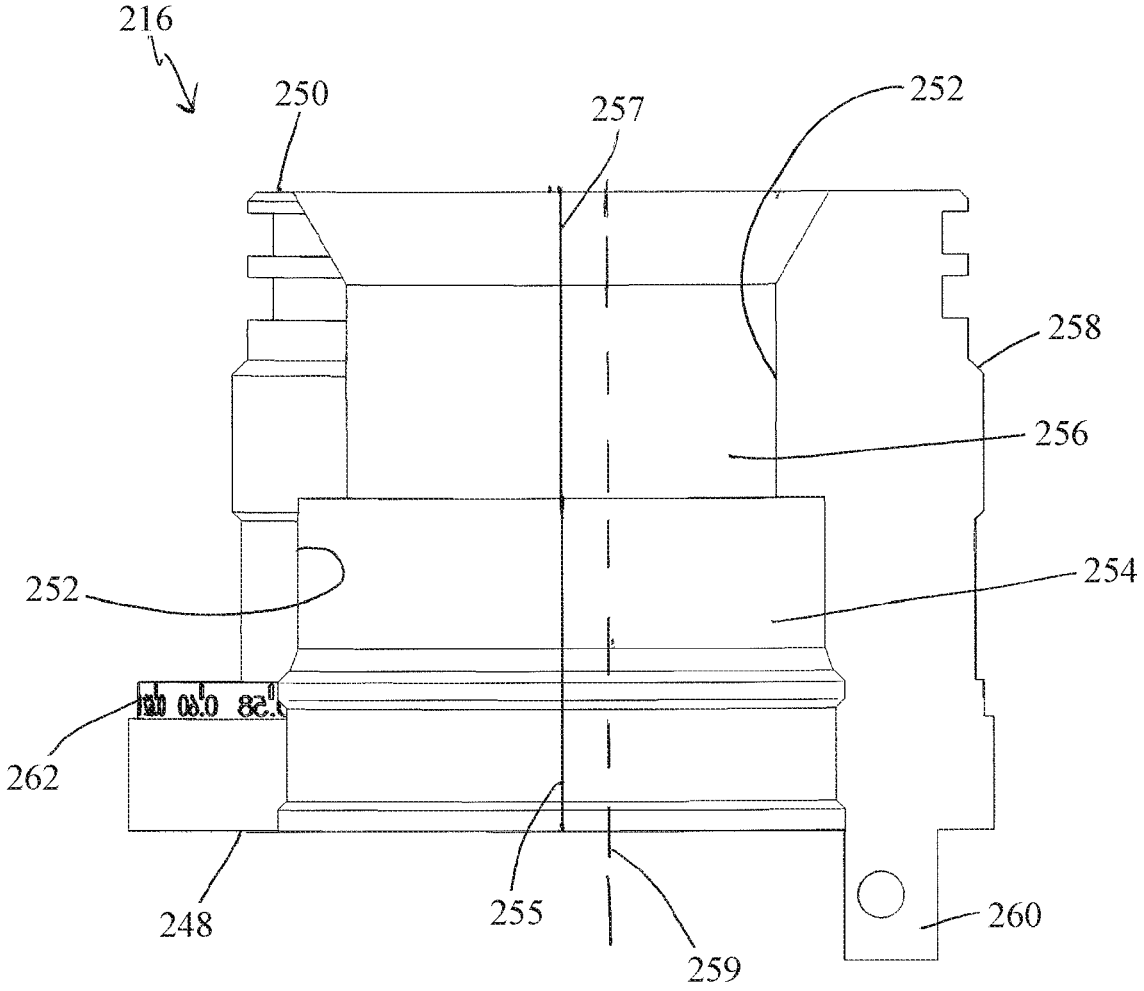
FIG. 12 is a cross-sectional view of the first offset collar of FIG. 10, according to one or more embodiments.

FIGS. 10-12 illustrate the first offset collar 216, according to one or more embodiments. The first offset collar 216 may include a tubular member having a cylindrical shape extending between a first end 248 and a second end 250. The first offset collar 216 may be configured to be arranged between the second tilting coupler 214 and the second offset collar 218. The first offset collar 216 may additionally have an inner wall 252 defining a generally circular bore extending through the collar between the first 248 and second 250 ends. The first offset collar 216 may have an outer wall 258, and a wall thickness defined between the inner 252 and outer walls.

As shown particularly in FIG. 12, the first offset collar 216 may have a first inner bore 252, which may be a lower bore portion, and a second inner bore 256, which may be an upper bore portion. The lower bore portion 252 may be arranged proximate to the first end 248, and may be sized and configured to align with the upper bore portion 242 of the second tilting coupler 214. The lower bore portion 252 may have a diameter of between approximately 1.5 inches and approximately 10 inches, or between approximately 3 inches and approximately 5 inches. In some embodiments, the lower bore portion 252 may have a diameter of approximately 3.5 inches, 3.75 inches, 4 inches, or 4.25 inches. The lower bore portion 252 may have a length, extending upward from the first end 248 and perpendicular to the diameter, of between approximately 0.5 inches to approximately 4 inches, or between approximately 1 inch and approximately 2 inches. In some embodiments, the lower bore portion 252 may have a length of approximately 1.5 inches, 1.6 inches, 1.7 inches, 1.8 inches, 1.9 inches, 2 inches, or 2.1 inches. In other embodiments, the lower bore portion 252 may have any other suitable diameter and length. The upper bore portion 256 may be arranged proximate to the second end 250, and may be sized and configured to align with a bore extending through the second offset collar 218. The upper bore portion 256 may have a diameter of between approximately 1 inch and approximately 8 inches, or between approximately 2 inches and approximately 4 inches. In some embodiments, the upper bore portion 256 may have a diameter of approximately 2.85 inches, 3 inches, 3.15 inches, 3.3 inches, 3.45 inches, or 3.6 inches. The upper bore portion 256 may have a length, extending from the second end 250 and perpendicular to the diameter, of between approximately 0.5 inches to approximately 6 inches, or between approximately 1 inch and approximately 3 inches. In some embodiments, the upper bore portion 256 may have a length of approximately 2.2 inches, 2.5 inches, or 2.7 inches. In other embodiments, the upper bore portion 256 may have any other suitable diameter and length. In some embodiments, the upper bore portion 252 may have a flared mouth or opening at the second end 250. In other embodiments, the first offset collar 216 may have more or fewer bore portions.

In some embodiments, the two bore portions 254, 256 may have different diameters. In particular, the upper and lower bore portions 254, 256 may be configured such that a smallest inner diameter of the bore portions may be arranged within the upper bore portion 256, and a largest diameter may be arranged within the lower bore portion 254. It is additionally to be appreciated that the lower bore portion 254 may have a larger diameter than the upper bore portion 242 of the second tilting coupler 214.

Additionally, in some embodiments, one or both bore portions 254, 256 of the first offset collar 216 may have a laterally offset longitudinal axis. In particular, a longitudinal axis 255 of the lower bore portion 254 and/or a longitudinal axis 257 of the upper bore portion 256 may be laterally offset by a distance from a central axis 259 of the first offset collar 216, as defined by the outer wall 258 of the collar. This may be seen particularly in FIGS. 11 and 12. As shown, a wall thickness between the inner 252 and outer 258 walls of the first offset collar 216 may vary due to the offset arrangement of the inner bore portions 254, 256. In this way, as the first offset collar 216 is rotated with respect to other portions of the adjustment portion 204, the collar may rotate about its central axis 259. Thus as the collar 216 rotates about central axis 259, the position of axes 255 and 257 of the bore portions 254, 256 may shift laterally with respect to other bores of the adjustment portion 204. In some embodiments, the axes 255, 257 may each be offset from a central axis 259 of the first offset collar 216 by a distance of less than 1 inch, or less than 0.5 inches. In some embodiments, each axis 255, 257 may be offset from the central axis 259 by a distance of approximately 0.3 inches. As shown in FIG. 12, the longitudinal axes 255, 257 of the two bore portions 254, 256 may be aligned with one another, such that the two bore portions are laterally offset a same distance from the central axis 259 of the first collar 216. However, in other embodiments, the axes 255, 257 of the bore portions 254, 256 may be offset from one another, and in some embodiments, only one of the two bore portions may be offset laterally within the collar so as to have varying sidewall thickness.

At the first end 248, the first offset collar 216 may be configured to couple to the second tilting coupler 214. Additionally, the first offset collar 216 may be configured to rotate with respect to the second coupler 214. Any suitable coupling mechanisms may be used to allow the first collar 216 to rotate with respect to the second coupler 214. In some embodiments, the lower bore portion 254 may be configured to receive the second end 236 of the second tilting coupler 214. In some embodiments, a threaded mechanism may couple the components together and allow for rotation. For example, the second tilting coupler 214 may have threading, such as external threading, at the second end 236, and the first offset collar 216 may have corresponding internal threading within the lower bore portion 254. The first offset collar 216 may additionally have a tab 260 extending from the first end 248. The tab 260 may be configured to overlap an outer wall of the second tilting coupler 214. As shown for example in FIG. 3, the tab 260 may also be configured to lock the first offset collar 216 in a fixed rotational position relative to the second tilting coupler 214 by way of a clamp 280.

At the second end 250, the first offset collar 216 may be configured to couple to the second offset collar 218, the connection to which is described in more detail below. In some embodiments, the first offset collar 216 may have ledges or ridges arranged at the second end 250 configured to receive one or more seal rings to seal the connection to the first offset collar 216.

In some embodiments, the first offset collar 216 may have a circular gauge 262 arranged about the outer surface 258 of the collar. The gauge 262 may be configured for identifying an amount of offset of the central bore 210, or a portion thereof. The gauge 262 is described in more detail below.

Figure 13:
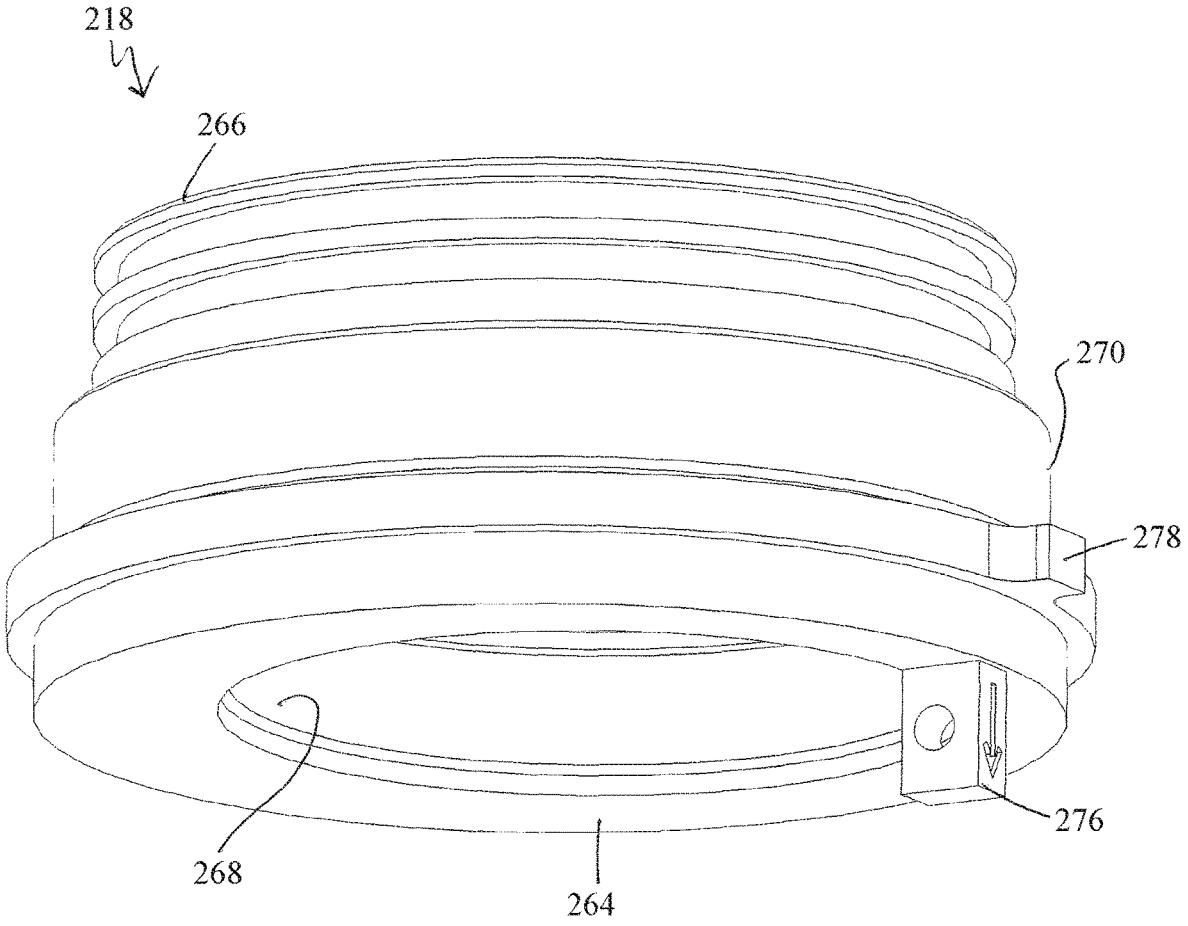
FIG. 13 is perspective view of a second offset collar of an adjustable blowout preventer adjustment portion, according to one or more embodiments.
Figure 14:
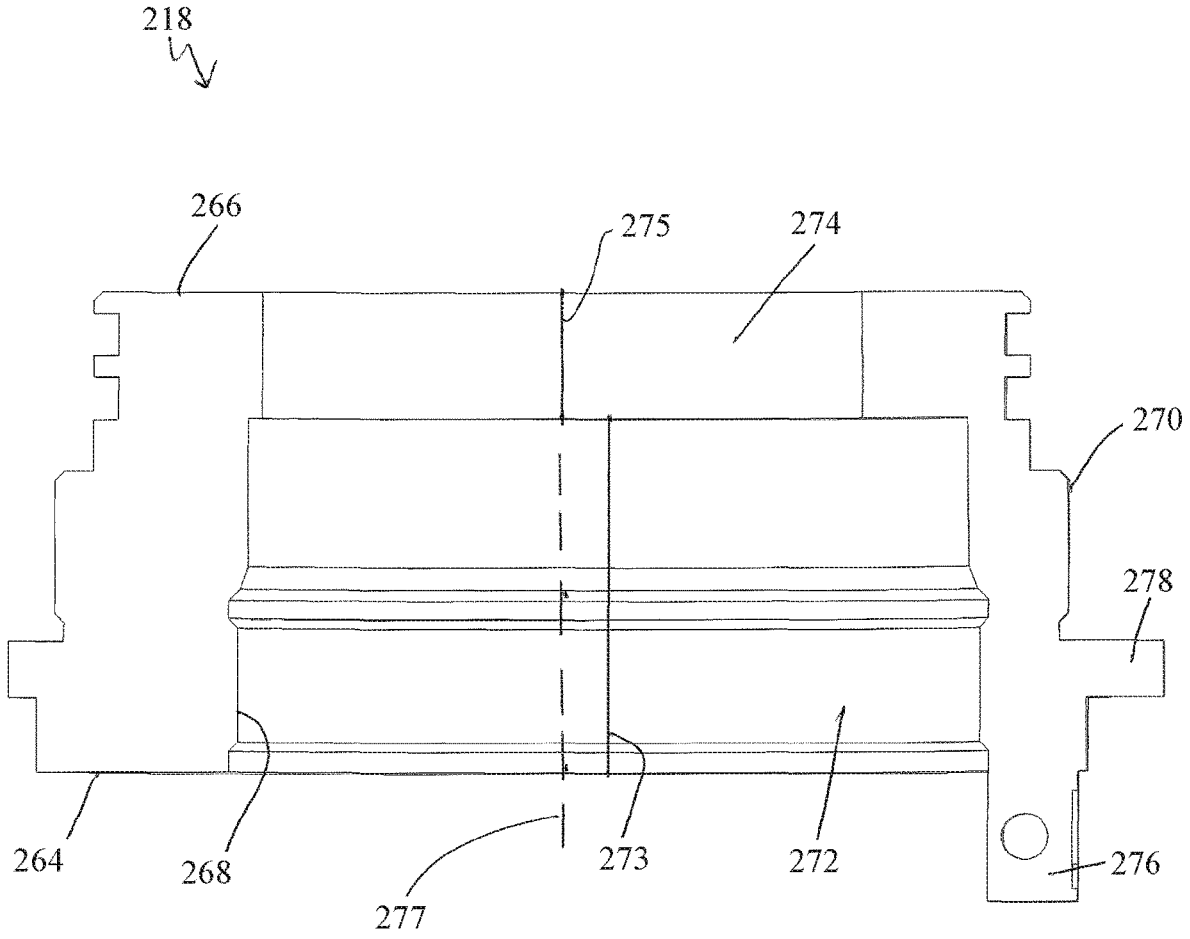
FIG. 14 is a cross-sectional view of the second offset collar of FIG. 13, according to one or more embodiments.

FIGS. 13 and 14 illustrate the second offset collar 218, according to one or more embodiments. The second offset collar 218 may include a tubular member having a cylindrical shape extending between a first end 264 and a second end 266. The second offset collar 218 may be configured to be arranged between the first offset collar 216 and the stack 202. The second offset collar 218 may additionally have an inner wall 268 defining a generally circular bore extending through the collar between the first 264 and second 266 ends. The second offset collar 218 may have an outer wall 270, and a wall thickness defined between the inner 268 and outer walls.

As shown particularly in FIG. 14, the second offset collar 218 may have a first inner bore 272, which may be a lower bore portion, and a second inner bore 274, which may be an upper bore portion. The lower bore portion 272 may be arranged proximate to the first end 264, and may be sized and configured to align with the upper bore portion 256 of the first offset collar 216. The lower bore portion 272 may have a diameter of between approximately 2 inches and approximately 12 inches, or between approximately 4 inches and approximately 6 inches. In some embodiments, the lower bore portion 272 may have a diameter of approximately 4.8 inches, 4.9 inches, 5 inches, 5.5 inches, 5.6 inches, or 5.7 inches. The lower bore portion 272 may have a length, extending upward from the first end 264 and perpendicular to the diameter, of between approximately 1 inch and approximately 8 inches, or between approximately 2 inches and approximately 4 inches. In some embodiments, the lower bore portion 272 may have a length of approximately 2.4 inches, 2.5 inches, 3 inches, or 3.2 inches. In other embodiments, the lower bore portion 272 may have any other suitable diameter and length. The upper bore portion 274 may be arranged proximate to the second end 266, and may be sized and configured to align with a bore extending through the stack 202. The upper bore portion 274 may have a diameter of between approximately 1.5 inches and approximately 10 inches, or between approximately 3 inches and approximately 5 inches. In some embodiments, the upper bore portion 274 may have a diameter of approximately 4 inches, 4.25 inches, 4.5 inches, or 4.75 inches. The upper bore portion 272 may have a length, extending from the second end 266 and perpendicular to the diameter, of between approximately 0.25 inches and approximately 4 inches, or between approximately 0.5 inches and approximately 2 inches. In some embodiments, the upper bore portion 274 may have a length of approximately 1 inch, 1.1 inches, or 1.2 inches. In other embodiments, the upper bore portion 274 may have any other suitable diameter and length. In other embodiments, the second offset collar 218 may have more or fewer bore portions.

In some embodiments, the two bore portions 272, 274 may have different diameters. In particular, the upper and lower bore portions 272, 274 may be configured such that a smallest inner diameter of the bore portions may be arranged within the upper bore portion 274, and a largest diameter may be arranged within the lower bore portion 2742. It is additionally to be appreciated that the lower bore portion 272 may have a larger diameter than the upper bore portion 256 of the first offset collar 216.

Additionally, in some embodiments, one or both bore portions 272, 274 of the second offset collar 218 may have a laterally offset longitudinal axis. In particular, a longitudinal axis 273 of the lower bore portion 272 and/or a longitudinal axis 275 of the upper bore portion 274 may be laterally offset by a distance from a central axis 277 of the collar 218, as defined by the outer wall 270. In at least one embodiments, the longitudinal axis 273 of the lower bore portion 272 may be laterally offset from the central axis 277, while the axis 275 of the upper bore portion 274 may be centrally arranged within the collar 218 and aligned with central axis 277. For example, the axis 273 of the lower bore portion 272 may be laterally offset from the central axis 277 of the collar 218 by less than 1 inch or less than 0.5 inches. In some embodiments, the axis 273 may be laterally offset from the central axis 277 by a distance of approximately 0.3 inches. As shown in FIGS. 13 and 14, a wall thickness between the inner 268 and outer 270 walls of the second offset collar 218 may vary surrounding the lower bore portion 272 due to its offset position. In this way, as the second offset collar 218 is rotated with respect to other portions of the adjustment portion 204, the collar may rotate about central axis 277. As the collar 218 rotates about axis 277, the longitudinal axis 273 of the lower bore portion 272 may shift laterally, while the longitudinal axis 275 of the upper bore portion 274 remains centrally arranged within the second collar. It is to be appreciated that in other embodiments, the bore portions 272, 274 may be arranged differently within the second collar 218 such that the longitudinal axes 273, 275 of both bore portions shift laterally, or such that the lower bore portion is centrally arranged while the upper bore portion shifts laterally.

At the first end 264, the second offset collar 218 may be configured to couple to the second end 250 of the first offset collar 216. Additionally, the second offset collar 218 may be configured to rotate with respect to the first offset collar 216. Any suitable coupling mechanisms may be used to allow the second collar 218 to rotate with respect to the first collar 216. In some embodiments, the lower bore portion 272 may be configured to receive the second end 250 of the first collar 216. In some embodiments, a threaded mechanism may couple the components together and allow for rotation. For example, the lower bore portion 272 may have threading configured to engage with external threading arranged at the second end 250 of the first collar 216. Such threading may allow the second collar 218 to couple to the first collar 216, and may additionally allow the second collar to rotate with respect to the first collar. The second offset collar 218 may additionally have a tab 276 extending from the first end 264. The tab 276 may be configured to overlap an outer wall of the first offset collar 216. As shown for example in FIG. 3, the tab 276 may also be configured to lock the second offset collar 218 in a fixed rotational position relative to the first offset collar 216 by way of a clamp 280.

At the second end 266, the second offset collar 218 may be configured to couple to the stack 202. For example, a lower end of the stack 202 may be configured to receive the second end 266. Any suitable coupling mechanism may be used to couple the second end 266 to the stack 202. In some embodiments, the second offset collar 218 may have ridges or grooves arranged on the outer surface 270 for receiving one or more seal rings so as to seal the connection between the collar and the stack 202. Additionally, the second offset collar 218 may have a circular flange 278 extending from the outer surface 270 of the collar. The flange 278 may be configured to engage with or abut a lower surface of the stack 202. In some embodiments, the flange 278 may facilitate a connection to the stack 202.

As indicated above, and with reference back to FIGS. 10-12, the first offset collar 216 may have a gauge 262 configured for identifying an amount of offset of the first collar, second collar 218, and/or of the BOP 200 as a whole. For example, the gauge may identify an amount of lateral offset of the BOP 200 based upon lateral offsets of the bore portions 254, 256 of the first offset collar 216, lateral offsets of the bore portions 272, 274 of the second offset collar 218, and a rotational position between the first and second offset collars. The gauge 262 may have numbers and corresponding dashes arranged thereon. The numbers and dashes may correspond to an amount of offset, or an offset distance. In some embodiments, the gauge may identify an offset distance ranging between 0 and approximately 6 inches, or approximately 4 inches, or approximately 2 inches, or approximately 1 inch. The gauge 262 may be fixed on the first offset collar 216, such that as the second offset collar 218 rotates with respect to the first collar, the gauge may remain stationary. The second offset collar 218 may have an arrow, line, or other marking arranged thereon configured to align with the gauge 262 to identify the offset distance. For example, the tab 276 of the second offset collar 218 may have an arrow, line, or other marking arranged therein so as to designate an offset distance. It is to be appreciated that in other embodiments, the gauge 262 may be arranged on the second offset collar 218, and may be configured to rotate with the second collar. In still other embodiments, the first offset collar 216 may rotate with respect to the second offset collar 218.

Figure 15:
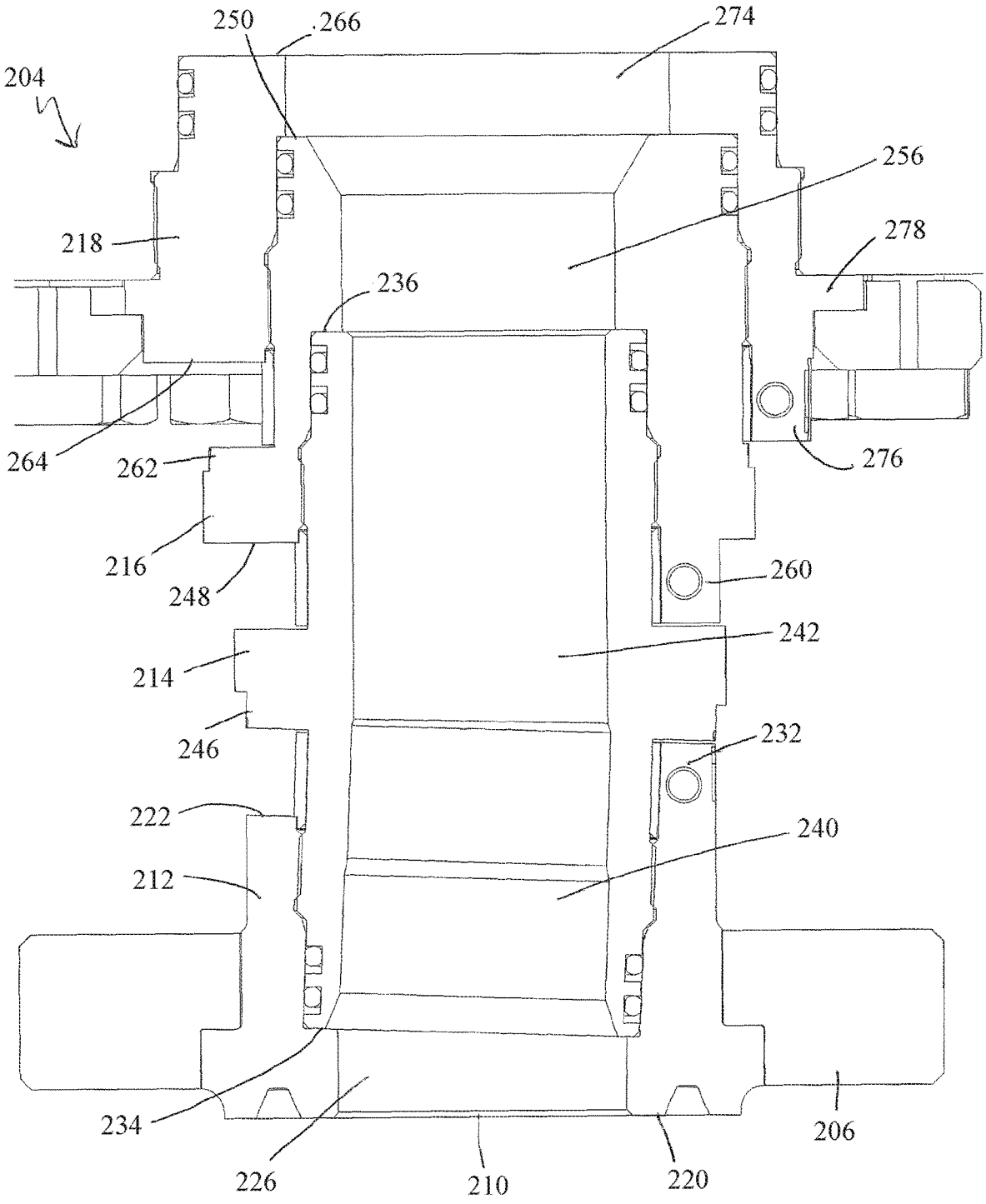
FIG. 15 is a cross-sectional view of the adjustment portion of the blowout preventer of FIG. 2, according to one or more embodiments.

Together, the various adjustment mechanisms of the adjustment portion 204 may be coupled together end-to-end to form a continuous bore extending between the stack 202 of the BOP 200 and the wellhead. FIG. 15 shows a cross sectional view of the couplers 212, 214 and collars 216, 218 arranged together to form a continuous bore.

In use, an adjustable blowout preventer 200 of the present disclosure may be used to mitigate or prevent damage or other issues caused by misalignment between a rod string and central bore 210 of the blowout preventer 200. In particular, when a rod string become misaligned with the central bore 210, which may occur over time as a result of drilling operations for example, the adjustment portion 204 of the adjustable BOP may be used to realign the central bore with the rod string, or to otherwise correct for the misalignment. In this way, damage or wear on the rod string or on the blowout preventer or other wellhead components that may otherwise result from the misalignment, may be mitigated or prevented. The adjustment portion 204 may be used to adjust both an angle of tilt of the central bore 210 and an offset distance of the central bore so as to coaxially align a longitudinal axis of the central bore with that of the rod string. Additionally, the adjustment portion 204 may be adjusted to orient or reposition the BOP into an upright or generally vertical position. The adjustment portion may be adjusted or readjusted as needed to accommodate shifts in the rod string.

The angle of tilt of the central bore 210 may be adjusted by rotating one or both of the tilting couplers 212, 214. Due to the angled longitudinal axes of bore portions within the first and/or second tilting couplers 212, 214, rotation of one or both of the tilting couplers may cause the tilt angle of central bore 210 above the couplers to shift. In some embodiments, adjusting an angle of tilt may particularly include rotating one of the tilting couplers 212, 214 with respect to the other of the tilting couplers. For example, the second tilting coupler 214 may be rotated with respect to the first tilting coupler 212. As the second tilting coupler 214 rotates about its connection to the first tilting coupler 212, the angled bore portions within each of the couplers may cause a shift in the angle of tilt of the central bore 210. For example, where the upper bore portion 228 of the first coupler 212 has a first longitudinal tilt, and the upper bore portion 242 of the second coupler 214 has a second longitudinal tilt, the degree of tilt of the central bore 210 may be defined as the combination of the first and second longitudinal tilts. It is to be appreciated that as the second tilting coupler 214 is rotated, the direction of the longitudinal tilt within the second coupler may shift, which in turn may alter the degree of tilt of the central bore 210.

The offset distance of the central bore 210 may be adjusted by rotating one or both of the offset collars 216, 218. Due to the longitudinal offset of bore portions within the first and/or second collars 216, 218, rotation of one or both of the collars may cause the offset distance of the central bore 210 above the collars to shift. In some embodiments, adjusting an offset distance may particularly include rotating one of the offset collars 216, 218 with respect to the other of the offset collars. For example, the second offset collar 218 may be rotated with respect to the first offset collar 216. As the second offset collar 218 rotates about its connection to the first offset collar 216, the offset bore portions within each of the couplers may cause a shift in the lateral position of the central bore 210. For example, where the first offset collar 216 has a bore portion with a first longitudinal offset, and the second offset collar 218 has a bore portion with a second longitudinal offset, the offset distance of the central bore 210 may be defined as the combination of the first and second longitudinal offsets. It is to be appreciated that as the second offset collar 218 is rotated, the position of the offset bore portion therein may shift, which in turn may alter the offset distance of the central bore 210.

Figure 17:
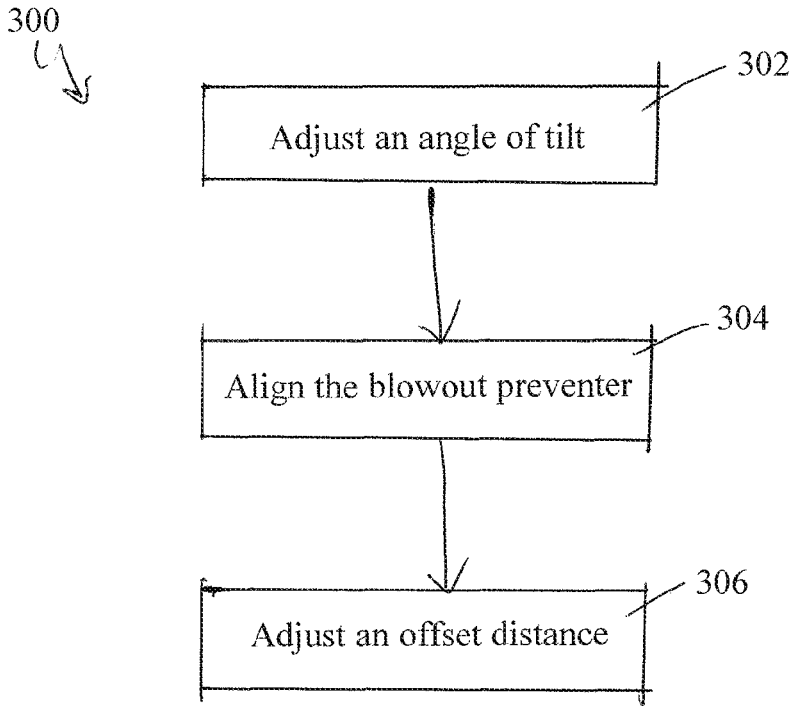
FIG. 17 is a flow diagram of a method of adjusting and adjustable blowout preventer of the present disclosure, according to one or more embodiments.

Turning now to FIG. 17, a method 300 of adjusting an adjustable blowout preventer of the present disclosure is shown, according to one or more embodiments. The method 300 may include the steps of adjusting an angle of tilt (302), aligning the blowout preventer (304), and adjusting an offset distance (306). In some embodiments, the method 300 may be performed upon determining that a rod string is, or has become, offset from the central bore of the BOP, or a portion thereof. Such determination may be made qualitatively or quantitatively. For example, an operator may determine based on a visual inspection that the rod string is offset from the central bore of the BOP. As another example, an operator may use a level to determine that the rod string is out of alignment. The method 300 may additionally or alternatively be performed upon setup or installation of the BOP, or at timed intervals, for example. In some embodiments, the method 300 may include additional or alternative steps.

Adjusting an angle of tilt (302) may include rotating at least one of the tilting couplers 212, 214 of the adjustment portion 204 so as to cause a rotational tilt of the central bore 210, or a portion thereof. For example, and as described above, the second tilting coupler 214 may be rotated with respect to the first tilting coupler 212. It is to be appreciated that rotating the second tilting coupler 214 may cause corresponding rotation of the components arranged above the tilting coupler, including the offset collars 216, 218 and the stack 202. As the second coupler 214 rotates, the upper bore portion 242 of the second coupler may rotate with respect to the fixed upper bore portion 228 of the first coupler 212, which in turn may cause an angle of tilt of the central bore 210 to change. The gauge 246 arranged on the second coupler 214 may provide an indication of the degree of tilt of the central bore 210 at each rotational position of the second coupler. An operator may use the gauge 246 to determine a desirable rotational position of the second coupler 214. Once the second coupler 214 is in a desired rotational position to achieve a desired angle of tilt to coaxially align the central bore 210 with the rod string, the rotational position of the second coupler may be locked or fixed. For example, a clamp 280 may be arranged around the connection between the first 212 and second 214 couplers, as described above.

Aligning the blowout preventer (304) may include rotating one or more components of the adjustment portion 204. Alignment of the blowout preventer 200 may be desirable to compensate for rotational positions of the first 212 and/or second 214 tilting couplers. For example, due to the angles of the upper bore portions 228 and 242 of the first 212 and second 214 couplers, rotation of the second tilting coupler in step (302) may cause the stack 202 to tilt in addition to the central bore 210. In some embodiments, the BOP 200 may be adjusted to return the stack 202 to vertical or approximately vertical alignment, while maintaining the tilt of the central bore 210 therein. In some embodiments, alignment of the blowout preventer 200 may be achieved by rotating the first offset collar 216 with respect to the second tilting coupler 214. Due to the longitudinal axis of the bore portions within the first offset collar 216, rotation of the first offset collar may shift the rotational position of the stack 202, to return the stack into vertical alignment, without altering the angle of tilt of the central bore 210. Once the first offset collar 216 is in a desired rotational position to achieve a desired alignment of the blowout preventer 200, the rotational position of the first collar may be locked or fixed. For example, a clamp 280 may be arranged around the connection between the second tilting coupler 214 and the first offset collar 216.

Adjusting an offset distance (306) may include rotating at least one of the offset collars 216, 218 of the adjustment portion 204 so as to cause a lateral offset of the central bore 210, or a portion thereof. For example, and as described above, the second offset collar 218 may be rotated with respect to the first offset collar 216. It is to be appreciated that rotating the second offset collar 218 may cause corresponding rotation of the components arranged above the offset collar, including the stack 202. As the second offset collar 218 rotates, the laterally offset lower bore portion 272 therein may rotate with respect to the offset bore portions 252, 254 of the first collar 216, which may in turn cause a lateral offset of the central bore 210 to change. The gauge 262 arranged on the first offset collar 216 may provide an indication of the offset distance of the central bore 210 at each rotational position of the second offset collar 218. An operator may use the gauge 262 to determine a desired rotational position of the second offset collar 218. Once the second offset collar 218 is in a desired rotational position to achieve a desired offset distance to coaxially align the central bore 210 with the rod string, the rotational position of the second offset collar may be locked or fixed. For example, a clamp 280 may be arranged around the connection between the first 216 and second 218 offset collars.

It is to be appreciated that the steps 302, 304, 306 may be performed in any suitable order. In particular, it is to be appreciated that the angle of tilt and offset distance may be adjusted in in any suitable order. Moreover, in some embodiments, adjusting the BOP may include adjusting only the angle or the offset. However, it is further to be appreciated that adjustment of the angle may, in some embodiments, necessitate adjustment of the offset to compensate for the angle further up or down the central bore. Similarly, in some embodiments, adjustment of the offset may necessitate some adjustment of the angle to compensate for up or down the central bore. Moreover, the steps of the method 300 may be repeated as needed to achieve a desired or suitable alignment.

Once the adjustment portion 204 has been adjusted to coaxially align the central bore 210 with a rod string, the BOP may be further rotated as needed to accommodate production piping and/or other structures or obstacles surrounding the wellhead. For example, the BOP may be lifted at its connection to the wellhead, and may be rotated as needed to accommodate production piping and/or other structures. In other embodiments, the stack may be rotated at its connection to the adjustment portion to accommodate production piping and/or other structures. It is to be appreciated that after rotating the BOP to accommodate production piping, the adjustment portion may be adjusted to realign, or make any additional adjustments to, the central bore. That is, in some embodiments, alignment of the central bore and positioning of the BOP with respect to production piping may be an iterative process.

Figure 18:
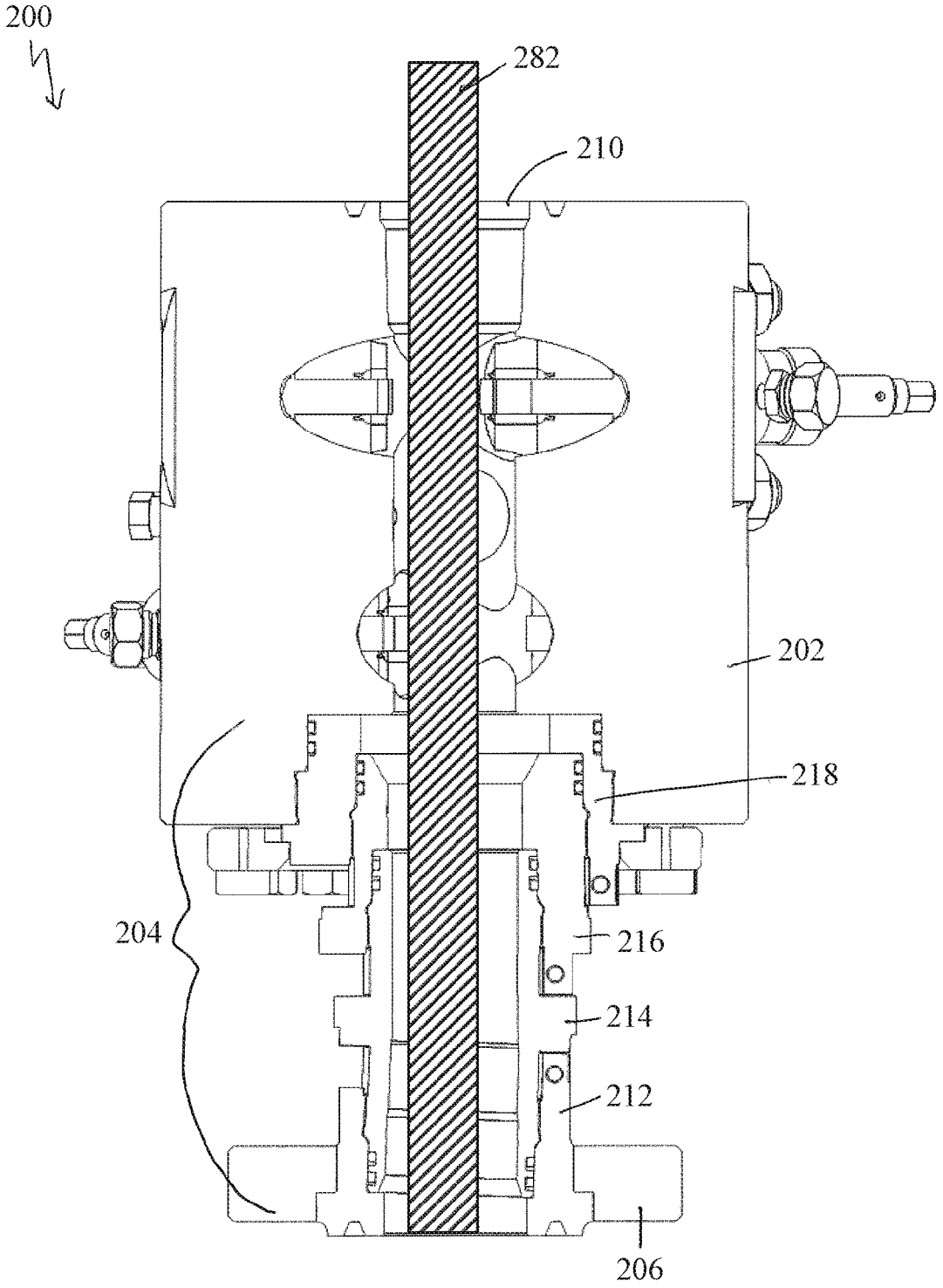
FIG. 18 is a cross-sectional view of an adjustable blowout preventer and a rod string arranged therein, according to one or more embodiments.

FIG. 18 illustrates an adjustable blowout preventer 200 of the present disclosure with a rod string 282 arranged therein. It may be appreciated from FIG. 18 that the rotation of various components of the adjustment portion 204 may affect the coaxial alignment of other portions of the central bore 210 with the rod string 282. For example, rotation of the second tilting coupler 214 to alter the angle of tilt of the central bore 210 may in turn cause too much tilt further up the bore at the first and second collars 216, 218 or at the stack 202. Thus, rotation of the first 216 and/or second 218 collars to adjust a position of the BOP 200 and/or to adjust an offset distance of the central bore 210 may compensate for the modified angle of tilt so as to better coaxially align the bore with the rod string 282.

Figure 19:
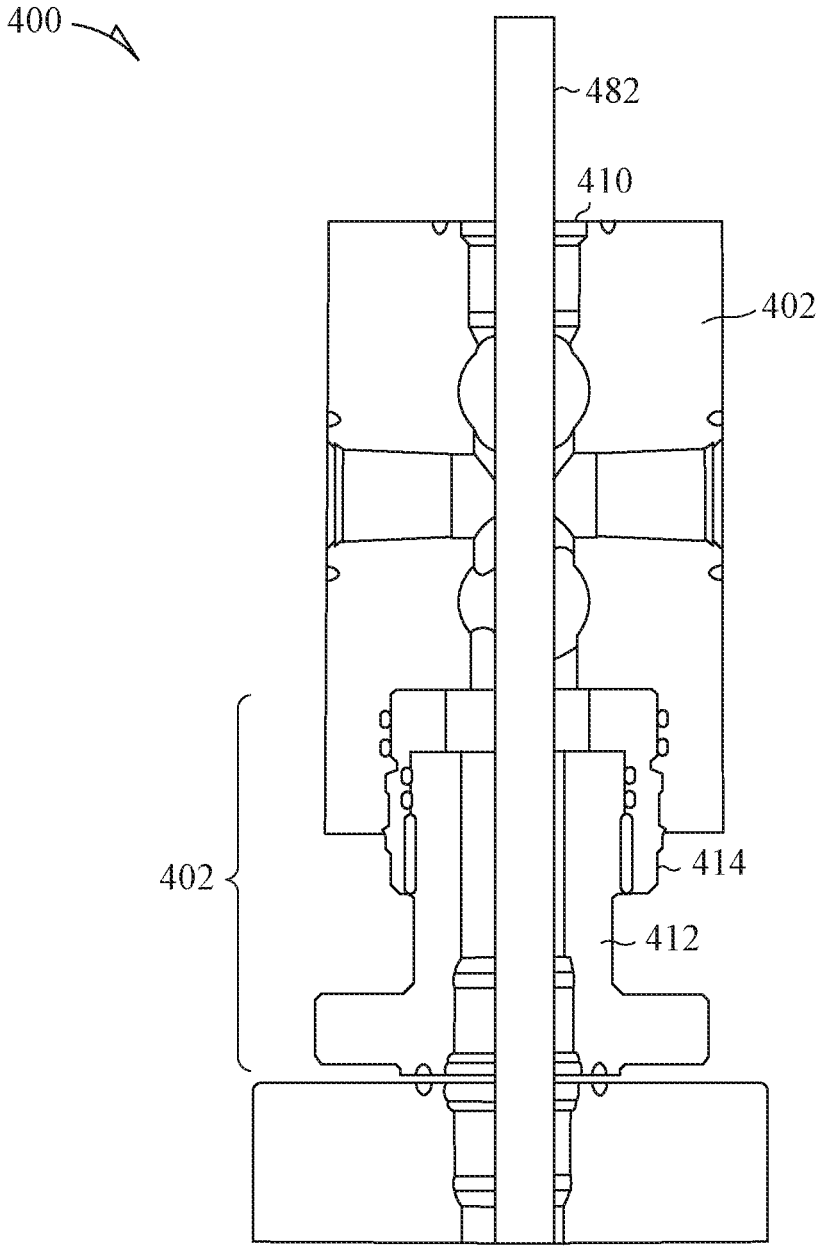
FIG. 19 is a cross-sectional view of another adjustable blowout preventer and a rod string arranged therein, according to one or more embodiments.

FIG. 19 illustrates another adjustable blowout preventer 400 of the present disclosure, according to one or more embodiments. As shown, the BOP 400 may have an adjustment portion 404 arranged generally beneath a stack 402. A central bore 410 may be arranged through the BOP and may be configured to receive a rod string 482. The adjustment portion 404 may have a first adjustment member 412 and a second adjustment member 414. Each of the two adjustment members 412, 414 may be or include offset collars configured for adjusting an offset distance of the BOP 400.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. An adjustable blowout preventer for arranging over a wellhead, the blowout preventer comprising:

a stack;

a central bore extending through the blowout preventer; and an adjustment portion configured to be arranged between the stack and the wellhead, the adjustment portion comprising:

first and second rotatable tilting couplers configured for adjusting an angle of tilt of the central bore, each rotatable tilting coupler having a pair of bore axes angled relative to one another, the first rotatable tilting coupler configured to sealingly receive the second rotatable tilting coupler; and first and second offset collars configured for adjusting an offset distance of the central bore, each offset collar having a pair of bore axes offset relative to one another, the second offset collar configured to sealingly receive the first offset collar.

2. The adjustable blowout preventer of claim 1, wherein the pair of bore axes of the rotatable tilting couplers are angled relative to one another by an angle of less than 10 degrees.

3. The adjustable blowout preventer of claim 1, wherein the pair of bore axes of the offset collars are offset by a distance of less than 4 inches.

4. The adjustable blowout preventer of claim 1, wherein the adjustment portion further comprises a tilt gauge for identifying the angle of tilt and an offset gauge for identifying the offset distance.

5. An adjustment apparatus for adjusting a central bore of a blowout preventer, the adjustment apparatus comprising:

first and second rotatable tilting couplers configured for adjusting an angle of tilt of the central bore, each rotatable tilting coupler having a pair of bore axes angled relative to one another, the first rotatable tilting coupler configured to sealingly receive the second rotatable tilting coupler; and first and second offset collars configured for adjusting an offset distance of the central bore, each offset collar having a pair of bore axes offset relative to one another, the second offset collar configured to sealingly receive the first offset collar.

6. The adjustment apparatus of claim 5, wherein the pair of bore axes of the rotatable tilting couplers are angled relative to one another by an angle of less than 10 degrees.

7. The adjustment apparatus of claim 5, wherein the pair of bore axes of the offset collars are offset by a distance of less than 4 inches.

8. The adjustment apparatus of claim 5, further comprising a tilt gauge for identifying the angle of tilt and an offset gauge for identifying the offset distance.

9. A method of adjusting a central bore of a blowout preventer, the method comprising:

inserting a second rotatable tilting coupler into a first rotatable tilting coupler;

inserting a first offset collar into a second offset collar;

adjusting an angle of tilt of the central bore by rotating the first and second rotatable tilting couplers relative to one another; and adjusting an offset distance of the central bore by rotating the first and second offset collars relative to one another.

10. The method of claim 9, the tilting coupler comprising a tubular member comprising:

a lower bore portion having a first longitudinal axis; and an upper bore portion having a second longitudinal axis angled away from the first longitudinal axis.

11. The method of claim 9, the offset collar comprising a tubular member comprising:

a lower bore portion having a first longitudinal axis; and an upper bore portion have a second longitudinal axis;

wherein at least one of the first and second longitudinal axes is laterally offset from a central axis of the offset collar.

12. The method of claim 9, the offset collar comprising a tubular member comprising:

a lower bore portion having a first longitudinal axis; and an upper bore portion have a second longitudinal axis;

wherein at least one of the first and second longitudinal axes is laterally offset from a central axis of the offset collar.

* * * * *